US010632360B2

(12) United States Patent
Warmouth et al.

(10) Patent No.: US 10,632,360 B2
(45) **Date of Patent: *Apr. 28, 2020**

(54) SPORTS HELMET WITH LINER SYSTEM

(71) Applicant: KRANOS IP CORPORATION, Litchfield, IL (US)

(72) Inventors: Cortney Warmouth, Edwardsville, IL (US); Louis Anthony VanHoutin, Iuka, IL (US); Vincent R. Long, St. Peters, MO (US)

(73) Assignee: Kranos IP Corporation, Litchfield, IL (US)

( * ) Notice: Subject to any disclaimer, the term of this patent is extended or adjusted under 35 U.S.C. 154(b) by 253 days.

This patent is subject to a terminal disclaimer.

(21) Appl. No.: 15/801,077

(22) Filed: Nov. 1, 2017

(65) Prior Publication Data

US 2018/0065027 A1 Mar. 8, 2018

Related U.S. Application Data

(63) Continuation of application No. 15/347,898, filed on Nov. 10, 2016, now Pat. No. 9,833,684, which is a (Continued)

(51) Int. Cl.
*A63B 71/08* (2006.01)
*A42B 3/20* (2006.01)
(Continued)

(52) U.S. Cl.
CPC ..... *A63B 71/081* (2013.01); *A42B 3/105* (2013.01); *A42B 3/122* (2013.01); *A42B 3/127* (2013.01); *A42B 3/20* (2013.01); *A42B 3/205* (2013.01); *A42B 3/283* (2013.01); *A42B 3/326* (2013.01); *A63B 2225/62* (2013.01)

(58) Field of Classification Search
CPC ..... A42B 3/105; A42B 3/20; A42B 3/326; A42B 3/122; A42B 3/127; A42B 3/205; A42B 3/283; A63B 71/081; A63B 2225/62
See application file for complete search history.

(56) References Cited

U.S. PATENT DOCUMENTS 3,994,021 A * 11/1976 Villari ..... A42B 3/125 2/413
4,566,137 A * 1/1986 Gooding ..... A42B 3/122 2/413
7,908,678 B2 * 3/2011 Brine, III ..... A42B 3/324 2/410

* cited by examiner

*Primary Examiner* — Anna K Kinsaul
(74) *Attorney, Agent, or Firm* — Notaro, Michalos & Zaccaria P.C.

(57) ABSTRACT

A sports helmet comprises a single-piece plastic shell, an occipital shock absorber attached to the inner surface of the shell in the rear region to at least partially overlie an occipital area of the head, an inflatable occipital pad removably attached to the inner surface of the shell in the rear region and positioned between the inner surface of the shell and the lateral padding assembly to push the occipital shock absorber forward when the occipital pad is inflated. The occipital pad comprises a top sheet and a bottom sheet bonded together, a plurality of inflatable pockets formed in the top sheet and fluidly connected through channels formed in the top sheet, a valve assembly for inflating the plurality of inflatable pockets, the valve assembly bonded to the bottom sheet. The valve assembly extends through a hole in the shell for inflation.

7 Claims, 36 Drawing Sheets

Related U.S. Application Data continuation of application No. 14/817,494, filed on Aug. 4, 2015, now abandoned, which is a continuation-in-part of application No. 14/674,484, filed on Mar. 31, 2015, now Pat. No. 10,201,206.

(60) Provisional application No. 62/082,415, filed on Nov. 20, 2014.

(51) Int. Cl.

| | |
|---|---|
| ***A42B 3/12*** | (2006.01) |
| ***A42B 3/10*** | (2006.01) |
| ***A42B 3/32*** | (2006.01) |
| ***A42B 3/28*** | (2006.01) |

SPORTS HELMET WITH LINER SYSTEM

CROSS-REFERENCE TO RELATED APPLICATIONS

This application is a continuation of U.S. patent application Ser. No. 15/347,898, filed Nov. 10, 2016, the contents of which are hereby incorporated by reference, which is a continuation of U.S. patent application Ser. No. 14/817,494, filed Aug. 4, 2015, the contents of which are hereby incorporated by reference, which is a continuation-in-part of U.S. patent application Ser. No. 14/674,484, filed Mar. 31, 2015, the contents of which are hereby incorporated by reference, and which also claims priority from U.S. Provisional Patent Application Ser. No. 62/082,415, filed Nov. 20, 2014, the contents of which are hereby incorporated by reference.

This application is also a continuation-in-part of U.S. patent application Ser. No. 14/674,484, filed Mar. 31, 2015, the contents of which are hereby incorporated by reference, which claims priority from U.S. Provisional Patent Application Ser. No. 62/082,415, filed Nov. 20, 2014, the contents of which are hereby incorporated by reference.

FIELD AND BACKGROUND OF THE INVENTION

The subject technology relates generally to the field of protective helmets, and in particular to helmets for lacrosse and similar sports.

SUMMARY

According to the subject technology, a lacrosse helmet comprises a rigid single-piece shell formed of a suitable material such as polycarbonate or acrylonitrile butadiene styrene plastic and adapted to receive and protect the head of a wearer.

The shell has acclivities (i.e. upward escarpments or slopes) integrally formed therein to define features in the shell. Said features may include two plateaus partially defined by acclivities and extending from the towards the crown. The plateaus converge toward the front region and diverge toward the rear region to form a generally V-shape. Valleys, depressions, and temporal plateaus may be fully defined or partially defined in the shell by acclivities on the left and right sides of the shell. The shell may have a channel extending from approximately the middle of the left side region, across the rear region to approximately the middle of the right side region.

The shell may have through-going ventilation holes located for example in its valleys and depressions and in the channel. Ventilation holes may be fully or partially surrounded by an acclivity which fully or partially follows the contours of the ventilation holes.

A full jaw protector may be removably or permanently attached to the shell with screws and T-nuts or may be integrally formed as part of shell. The jaw protector may have ventilation holes which may be fully or partially surrounded by acclivities.

A faceguard for protecting the face of the wearer and comprised of wire members may be removably attached to the shell with straps and/or nuts.

The helmet preferably includes padding assembles on its inner surface for shock absorption, protection, comfort, and to better size the helmet to the wearer. Two alternative padding assemblies are disclosed.

In a first alternative, the padding assemblies include a front liner installed in the brow area of the shell, a lateral liner extending around the back inner surface of the shell and backed by an inflatable occipital pad, a crown shock absorber, and jaw pads.

In a second alternative, the padding assemblies include an inner shell or bonnet comprising a left section, right section, and rear section, which are assembled together with a crown comfort layer and a rear comfort layer, and inserted into the shell. This alternative also includes jaw pads as in the first alternative.

Further advantages, as well as details of the present invention ensue from the following description of the attached drawings.

DETAILED DESCRIPTION OF THE DRAWINGS

I. Helmet Shell

Figure 1:
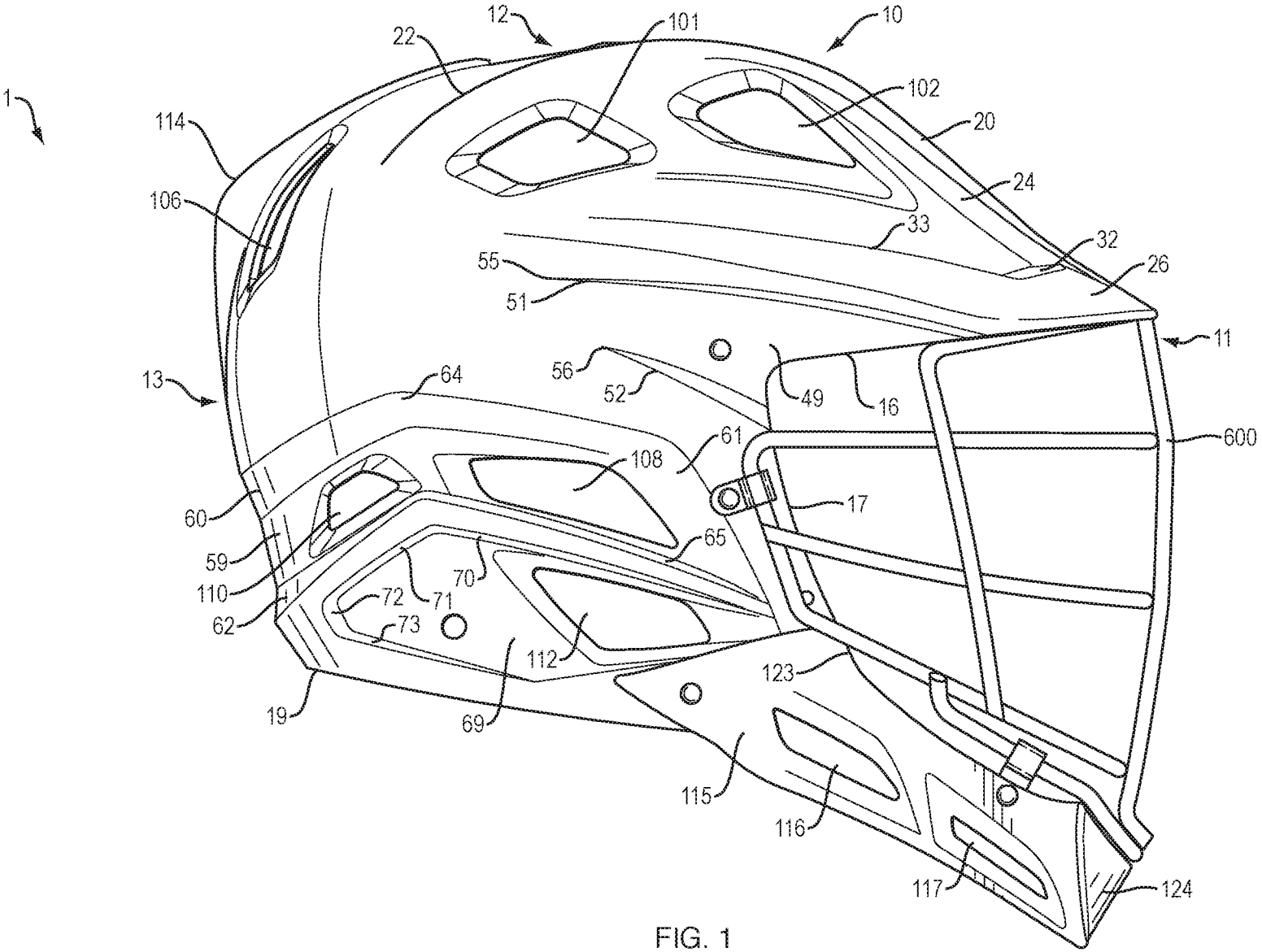
FIG. 1 is a right side view of the shell, jaw protector, and face guard of a sports helmet according to the subject technology.
Figure 2:
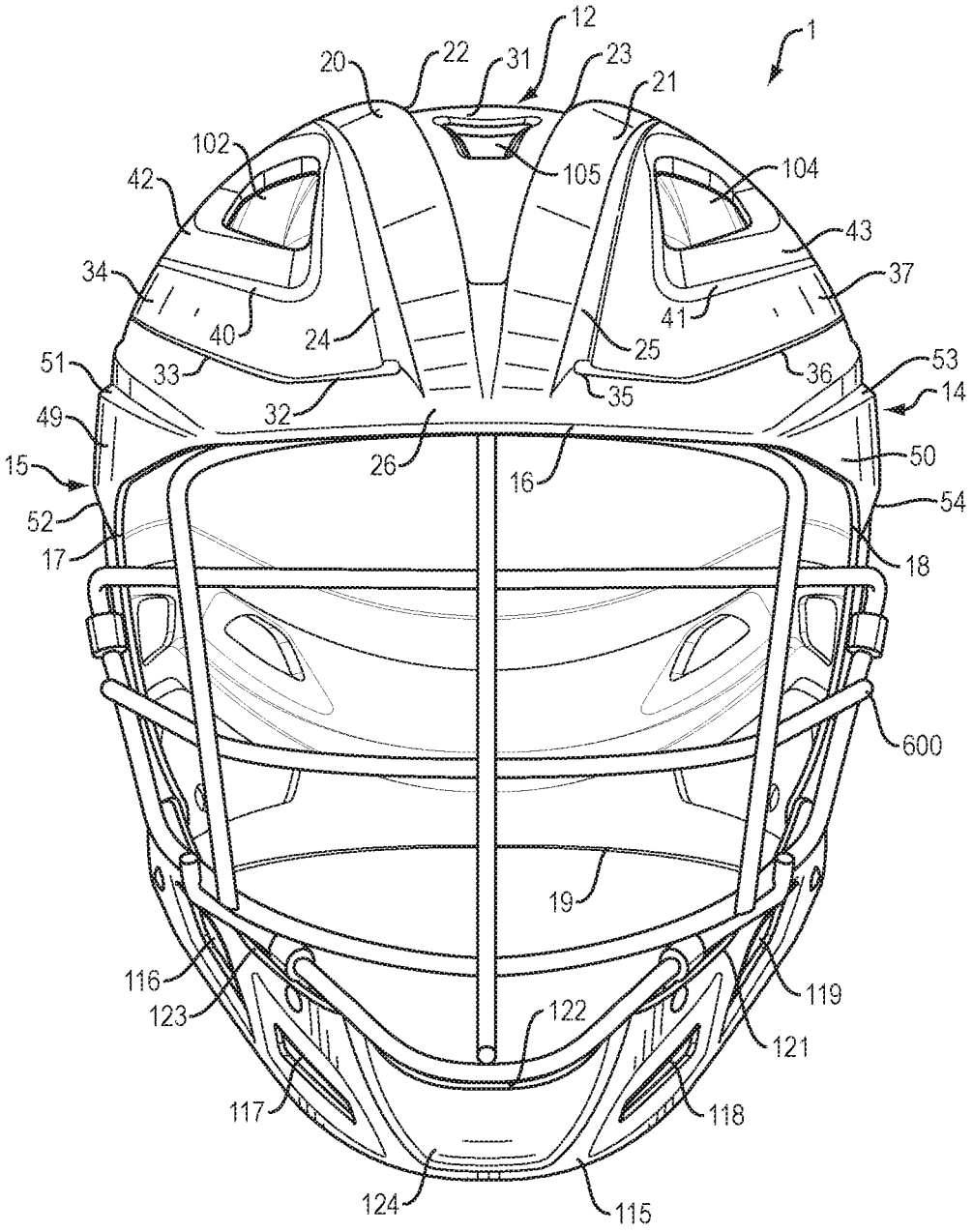
FIG. 2 is a front view of the shell, jaw protector, and face guard of a sports helmet according to the subject technology.
Figure 3:
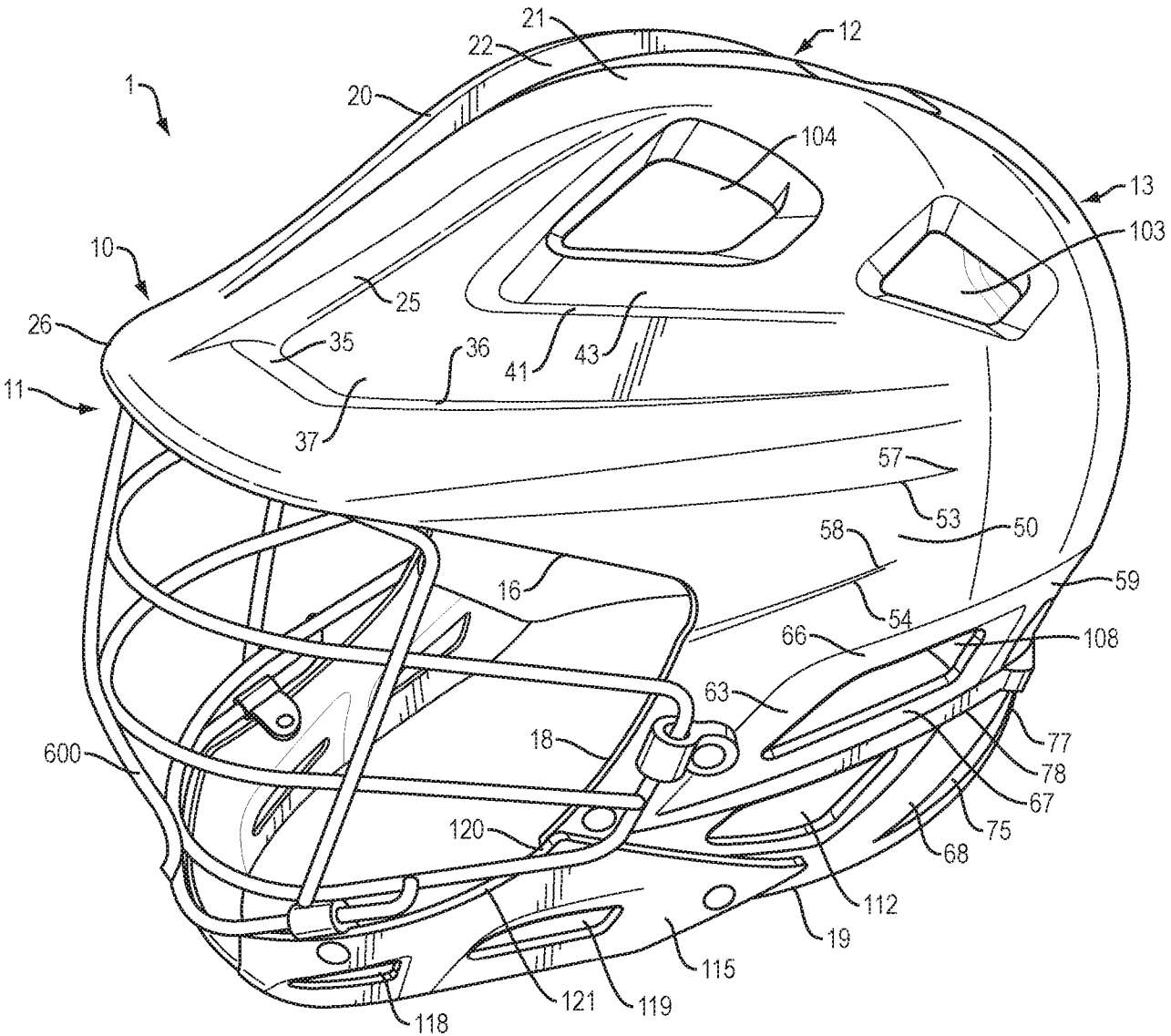
FIG. 3 is a right perspective view of the shell, jaw protector, and face guard of a sports helmet according to the subject technology.
Figure 4:
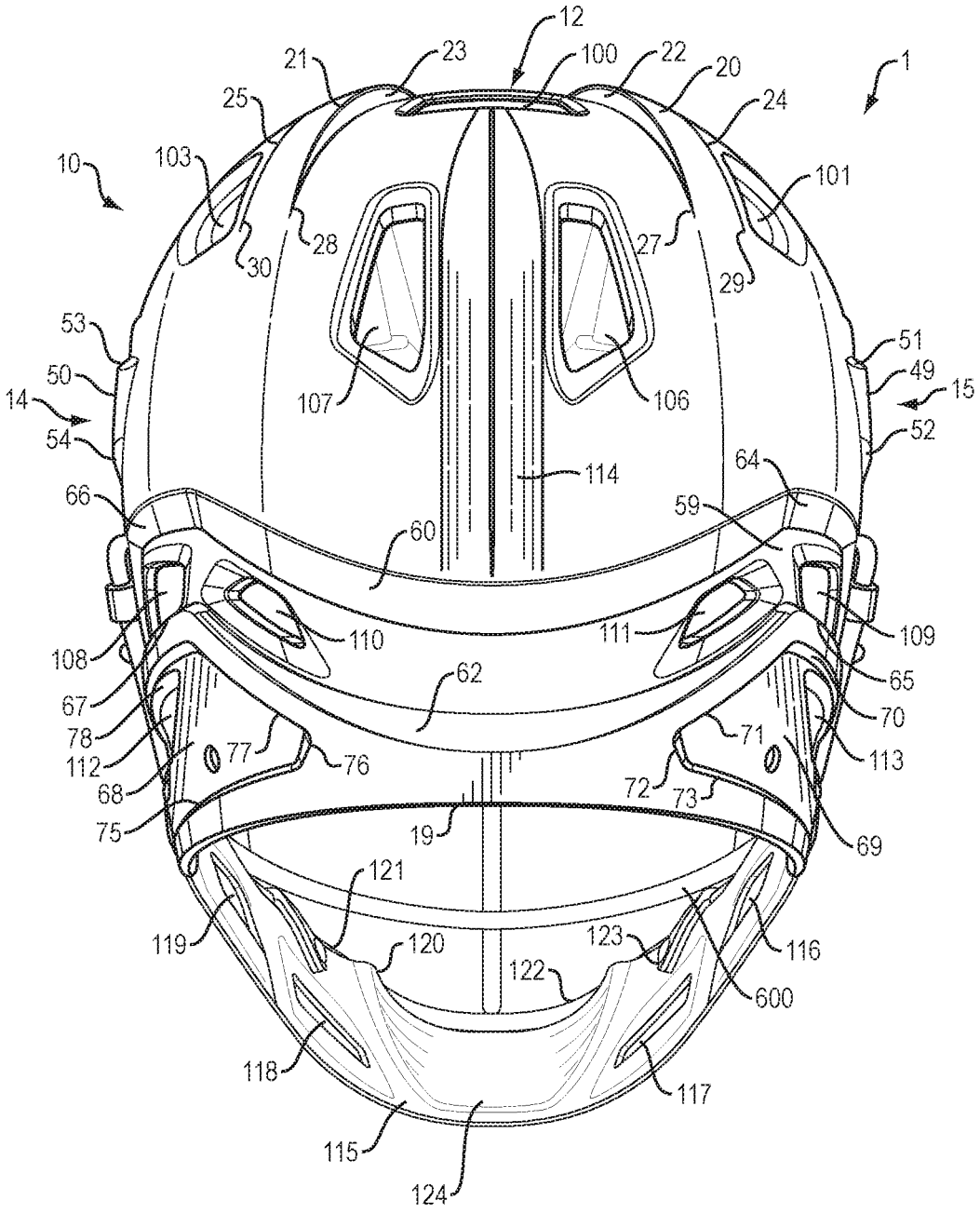
FIG. 4 is a rear view of the shell, jaw protector, and face guard of a sports helmet according to the subject technology.

Referring now to the drawings, in which like reference numerals are used to refer to the same or similar elements, FIGS. 1-6 show an embodiment of the shell, jaw protector, and face guard subject technology. Lacrosse helmet 1 comprises rigid single-piece shell 10 formed of a suitable material such as polycarbonate or acrylonitrile butadiene styrene plastic. Shell 10 may be fabricated by methods known to those of skill in the art such as injection molding. Shell 10 may have a thickness in the range of 0.11 inches to 0.14 inches, or 0.11 inches to 0.135 inches, or 0.11 inches to 0.13 inches. This is in contrast to a shell for use in football, which may have a thickness in the range of 0.14 inches and up.

In general configuration, shell 10 is adapted to receive and protect the head of a wearer. Shell 10 has an inner surface and an outer surface. Shell 10 has a front region 11, a crown region 12, a rear region 13, a left side region 14, and a right side region 15. Shell 10 is bordered by an edge comprising top front edge 16, right front edge 17, left front edge 18, and bottom edge 19.

Shell 10 has acclivities (i.e. upward escarpments or slopes) integrally formed therein to define features in the shell, as shown in FIGS. 1-9 and as hereinafter described. An acclivity may be sloped at any angle up to ninety degrees unless otherwise specified.

In an embodiment of the subject technology shown in FIGS. 1-6, the shell 10 has two plateaus 20, 21 partially defined by acclivities 22, 23, 24, 25 extending from the front 11 of the shell towards the crown 12. Right plateau 20 extends from the front region 11 of the shell 10, over the crown region 12 and toward the rear region 13, and is partially defined in shell 10 by acclivities 22 and 24. A left plateau 21 extends from the front region 11 of the shell 10, over the crown region 12 and toward the rear region 13 and is partially defined in shell 10 by acclivities 21 and 23. Plateaus 20, 21 converge toward the front region 11 of shell 10 and diverge toward the rear region 13 of shell 10 to form a generally V-shape. Preferably, as in FIG. 5, plateaus 20, 21 do not contact each other at any point. Instead, each plateau merges into brow plateau 26 at the front of the shell. In this embodiment, acclivities 22, 23 do not intersect. In an alternative embodiment, plateaus 20, 21 merge into a single plateau at the front region 11, which single plateau merges into brow plateau 26. In this alternative embodiment, acclivities 22, 23 meet near the front of the helmet.

Acclivities 22, 23, 24, 25 become shallower toward the rear of the helmet, ultimately vanishing at vanishing points 27, 28, 29, and 30 respectively. Preferably, vanishing points 29 and 30 are located in the crown region of the shell. Alternatively, vanishing points 29 and 30 could be located toward the front region of the shell thereby shortening acclivities 24 and 25. For example, vanishing points 29 and 30 could be located adjacent ventilation holes 101 and 103, respectively. Preferably, vanishing points 27, 28 are located in the rear region 13 of the shell 10. Alternatively, vanishing points 27, 28 could be located in the crown region of the shell thereby shortening acclivities 22, 23.

Acclivities 22, 23 also define a central valley 31 therebetween. Central valley 31 may be completely free of acclivities. Central valley 31 may contain ventilation holes as hereinafter described.

A right brow acclivity 32 and a right side acclivity 33 join acclivity 24 to partially define a right side valley 34. Similarly, a left brow acclivity 35 and a left side acclivity 36 join acclivity 25 to partially define a left side valley 37. Right side acclivity 33 and left side acclivity 36 become shallower toward the rear of the helmet, ultimately vanishing at vanishing points 38, 39. Preferably, vanishing points 38, 39 are located in a middle side region of shell 10. Alternatively, vanishing points 38, 39 could be located further toward the rear 13 of the shell 10, lengthening right side acclivity 33 and left side acclivity 36. Alternatively, vanishing points 38, 39 could be located closer to the front 11 of the shell 10, shortening right side acclivity 33 and left side acclivity 36.

Each of the right side valley 34 and left side valley 37 has a further generally V-shaped acclivity 40, 41 respectively, partially defining a right-front depression 42 and a left-front depression, 43 respectively. Depressions 42, 43 may contain ventilation holes as hereinafter described.

Brow plateau 26 is partially defined on a left side by left brow acclivity 35 and left side acclivity 36, on a right side by right brow acclivity 32 and right side acclivity 33, and the top front edge 16 of shell 10. The top front edge 16 may be extended toward the rear 13 of shell 10 in the form of acclivity 45 and acclivity 46. Acclivities 45, 46 may become shallower toward the rear 13 of shell 10, ultimately vanishing at vanishing points 47, 48 respectively. Preferably, vanishing points 47, 48 are located in a middle side region of shell 10. Alternatively, vanishing points 47, 48 could be located further toward the rear 13 of the shell 10, lengthening acclivities 45, 46. Alternatively, vanishing points 47, 48 could be located closer to the front 11 of the helmet, shortening acclivities 45, 46.

Shell 10 may have right and left temporal plateaus 49, 50. The right temporal plateau is partially defined by acclivities 51, 52 running from the right front edge 18 of shell 10 toward the rear 13 of the shell 10. The left temporal plateau 50 is partially defined by acclivities 53, 54 running from the left front edge 17 of the shell 10 toward the rear 13 of the shell 10. Acclivities 51, 52, 53, 54 become shallower toward the rear of the helmet, ultimately vanishing at vanishing points 55, 56, 57, 58 respectively. Preferably, vanishing points 55, 56, 57, 58 are located in a middle side region of shell 10. Alternatively, vanishing points 55, 56, 57, 58 could be located further toward the rear of the helmet, lengthening acclivities 51, 52, 53, 54. Alternatively, vanishing points 55, 56, 57, 58 could be located closer to the front of the helmet, shortening acclivities 51, 52, 53, 54.

Shell 10 may have a channel 59 extending from approximately the middle of left side region 14, across the rear region 13, to approximately the middle of the right side region 15 of shell 10. Channel 59 is fully defined by acclivities 60, 61, 62, 63, 64, 65, 66, 67. Acclivities 61, 63, 64, 65, 66, 67, may extend in an approximately straight direction. Acclivities 60, 62 may be curved downwards. Alternatively, acclivities 60, 62 may be extend in an approximately straight direction. Channel 59 may contain ventilation holes as hereinafter described.

Shell 10 may have a left lower side depression 68 and a right lower side depression 69. Left lower side depression 68 is partially defined by acclivities 75, 76, 77, 78. Right lower side depression 69 is partially defined by acclivities 71, 72, 73, 74. Left lower side depression 68 and right lower side depression 69 may contain ventilation holes as hereinafter described.

Shell 10 may have through-going ventilation holes. FIGS. 1-5 show an embodiment of the shell 10 of the subject technology having generally trapezoidal ventilation holes 100, 101, 102, 103, 104, 105, 106, 107, 108, 109, 110, 111, 112, 113. Ventilation holes may be formed in other shapes such as round, oval, and triangular. Ventilation holes may be fully or partially surrounded by an acclivity which fully or partially follows the contours of the ventilation holes.

In the embodiment shown, central valley 31 has exactly two ventilation holes 100, 105, both partially surrounded by acclivities. Alternatively, central valley 31 may have zero, one, three, or four ventilation holes, fully or partially surrounded by acclivities.

In the embodiment shown, each of the right side valley 34 and left side valley 37 has exactly two ventilation holes, 101, 102, and 103, 104, respectively. Ventilation holes 101, 102, and 103, 104 are surrounded by acclivities. More particularly, ventilation holes 102, 104 are partially surrounded by acclivities 42, 43 respectively, which also partially define right-front depression 42 and left-front depression 43. Ventilation holes 102, 104 are contained within right-front depression 42 and left-front depression 43, respectively. Alternatively, each of the right side valley 34 and left side valley 37 may have zero, one, three, or four ventilation holes, fully or partially surrounded by acclivities. Where present in the right side valley 34 and left side valley 37, ventilation holes may be defined forward of, inside of, or to the rear of right-front depression 42 and left-front depression 43.

In the embodiment shown, channel 59 has exactly four ventilation holes 108, 109, 110, 111. Ventilation holes 108, 109 are partially surrounded by acclivities, while ventilation holes 110, 111 are fully surrounded by acclivities. Alternatively, channel 59 may have two, three, or five ventilation holes, fully or partially surrounded by acclivities. Ventilation holes 108, 109 may be positioned in channel 59 to generally overlie the ear of the wearer to function as ear holes.

In the embodiment shown, each of left lower side depression 68 and right lower side depression 69 has exactly one ventilation hole, 112 and 113 respectively, each hole partially surrounded by acclivities. Alternatively, left lower side depression 68 and right lower side depression 69 may each have zero, two, or three ventilation holes, respectively.

Figure 5:
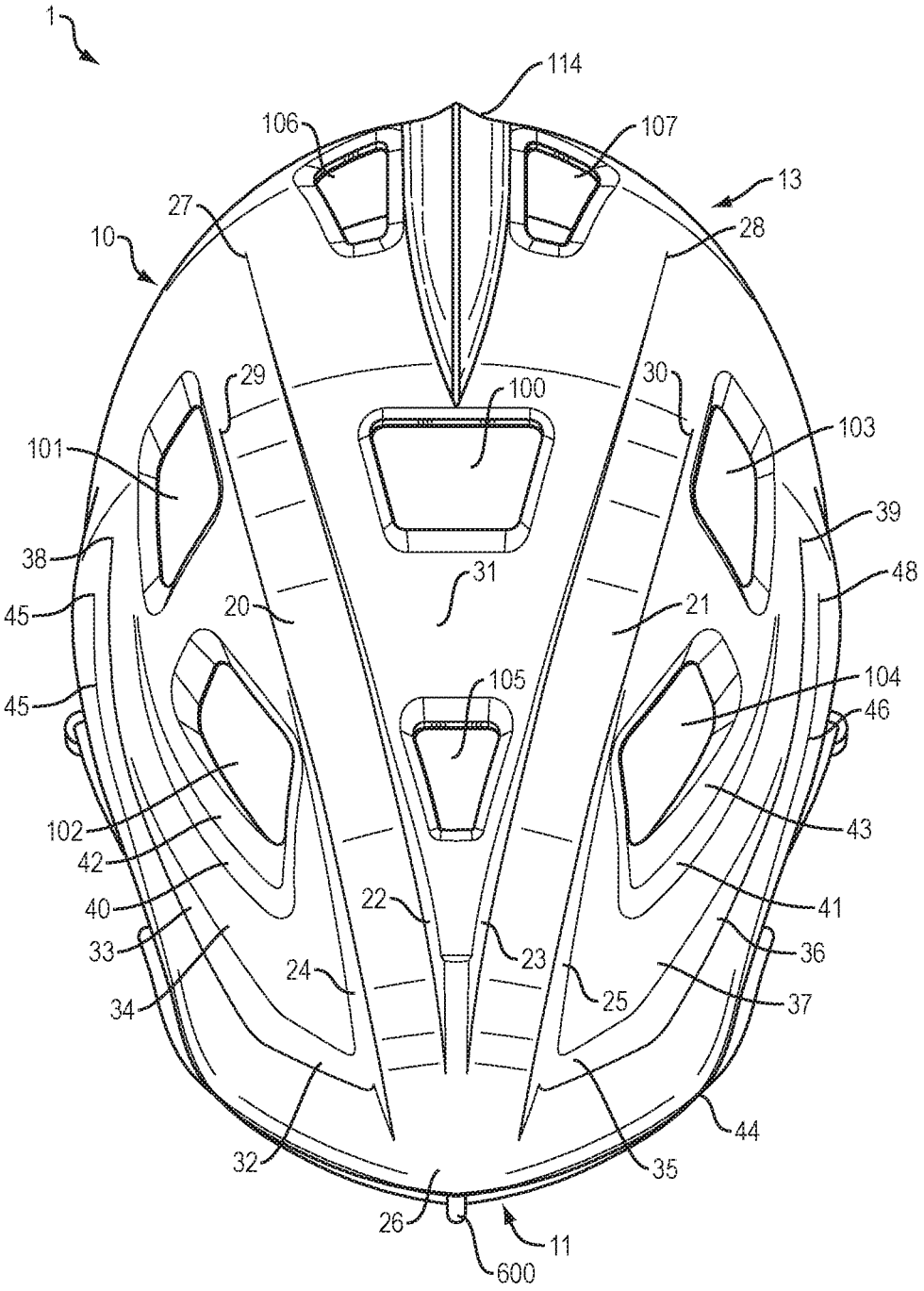
FIG. 5 is a top view of the shell, jaw protector, and face guard of a sports helmet according to the subject technology.
Figure 6:
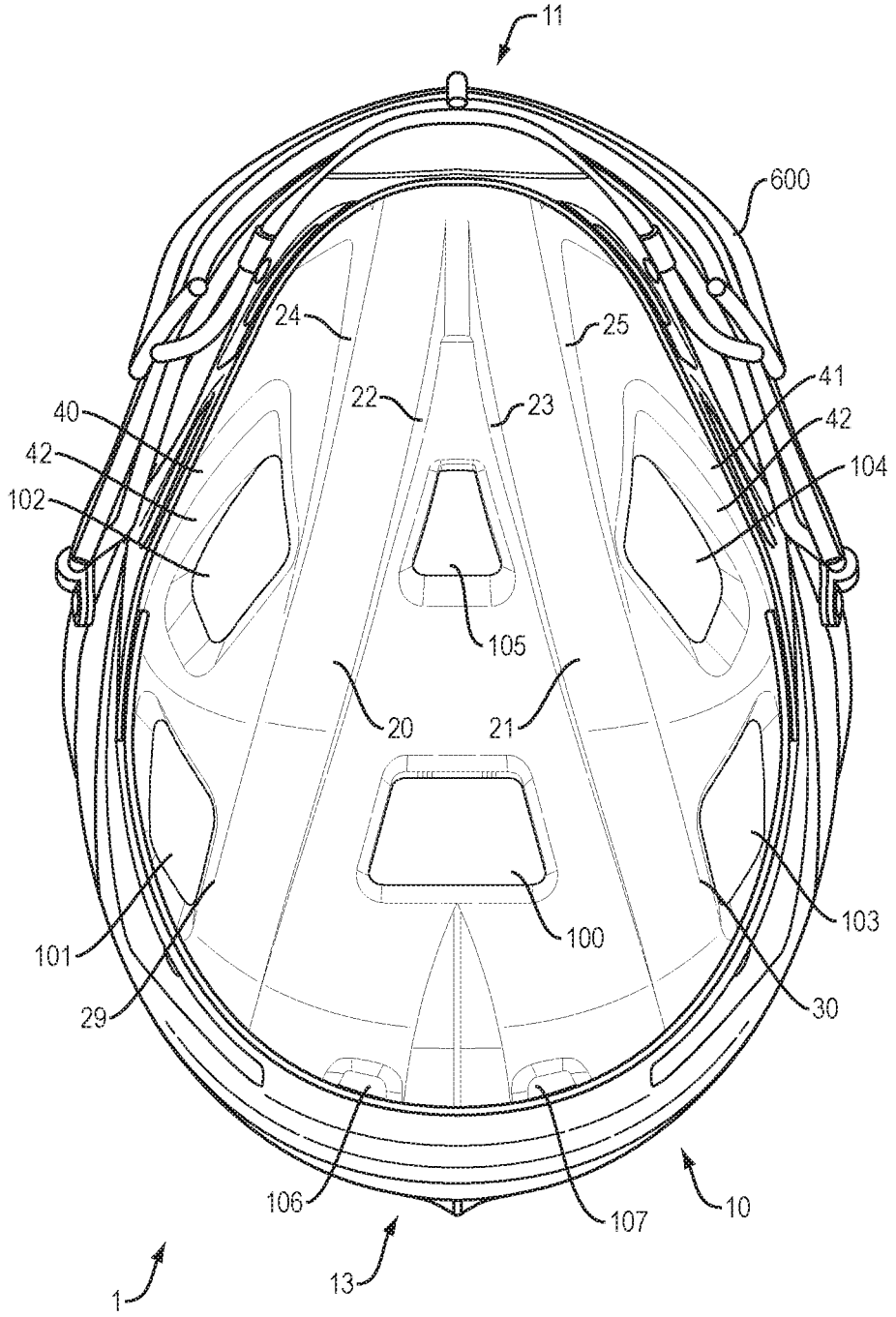
FIG. 6 is a bottom view of the shell, jaw protector, and face guard of a sports helmet according to the subject technology.

Ventilation holes may also be formed in the rear region of the shell. FIG. 5 shows two ventilation holes 106, 107 formed in the rear region of the shell, each hole fully surrounded by acclivities. Alternatively, the rear region may have zero, three, four, five, or six ventilation holes, fully or partially surrounded by acclivities.

Shell 10 may have a ridge 114 located in the rear region formed of two acclivities meeting at a center line to form the peak of the ridge. The ridge may be positioned between two ventilation holes 106, 107. The ridge may have a pointed, roughly triangular profile as best seen in FIGS. 1-6. Alternatively the ridge may have a smoothed, arcuate profile. Alternatively the ridge may be absent.

Figure 7A:
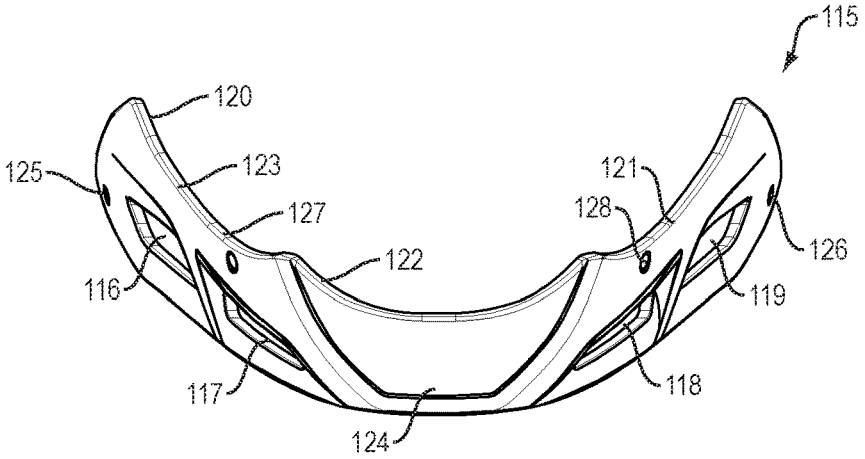
FIG. 7A is a front view of the jaw protector of a sports helmet according to the subject technology.
Figure 7B:
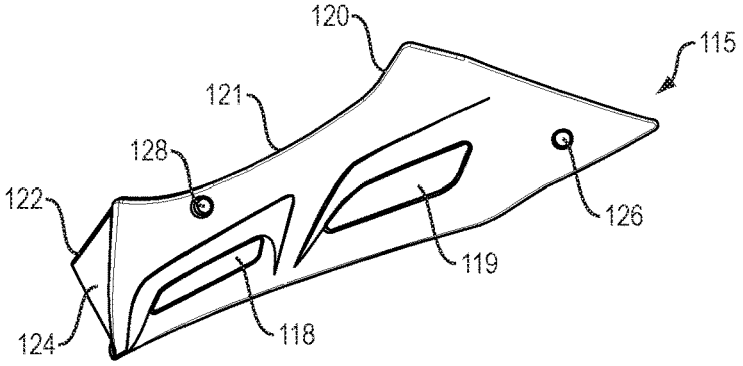
FIG. 7B is a left side view of the jaw protector of a sports helmet according to the subject technology.
Figure 7C:
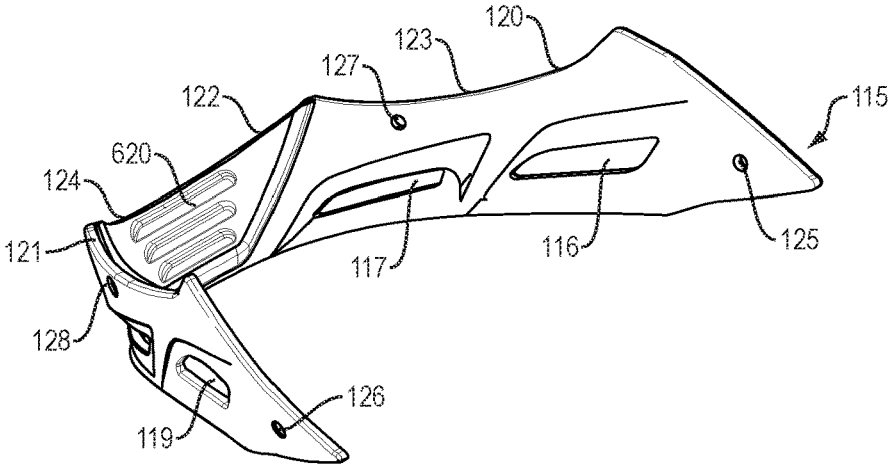
FIG. 7C is a perspective view of the jaw protector of a sports helmet according to the subject technology.
Figure 8:
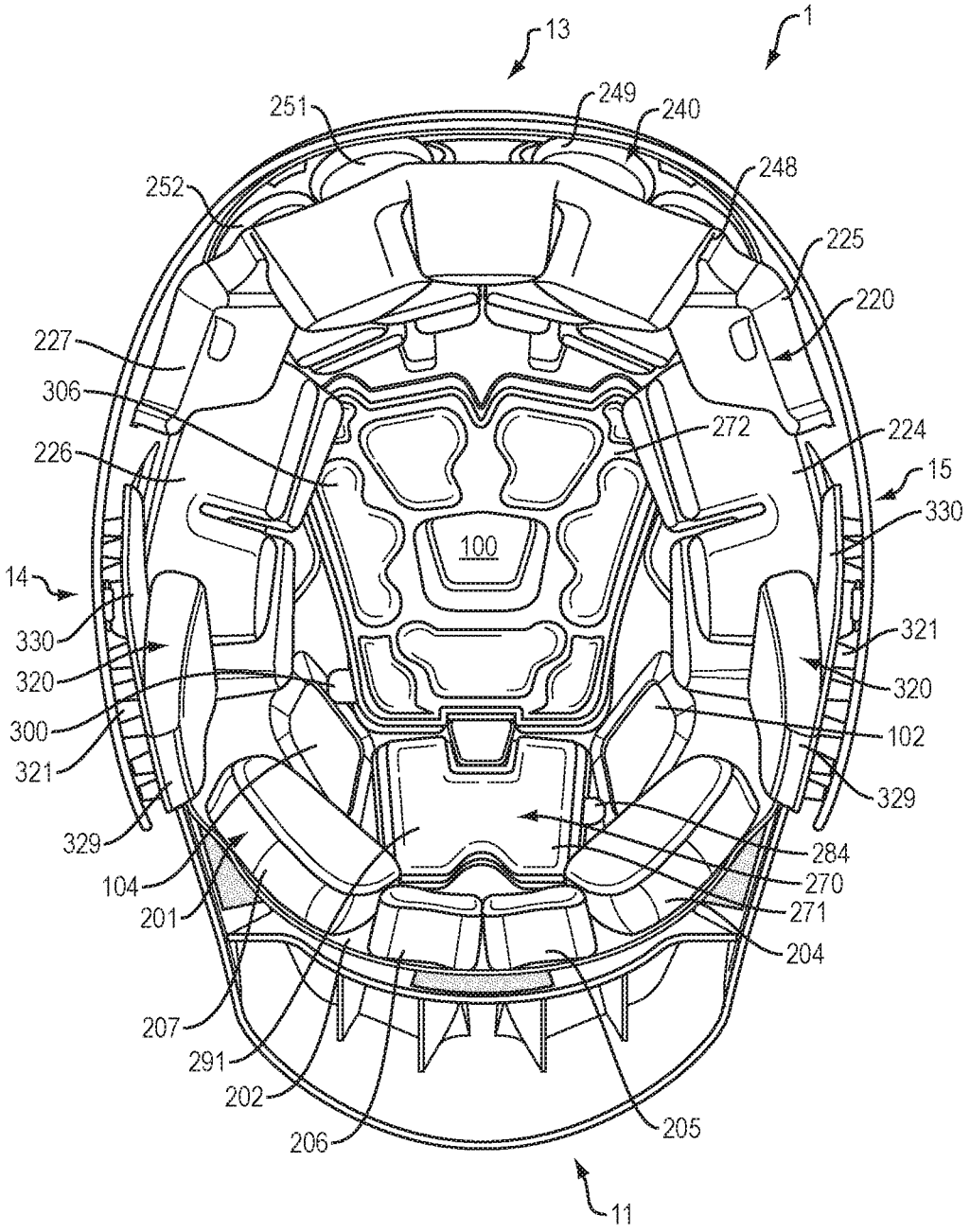
FIG. 8 is a bottom view of the helmet and padding of the subject technology.
Figure 9:
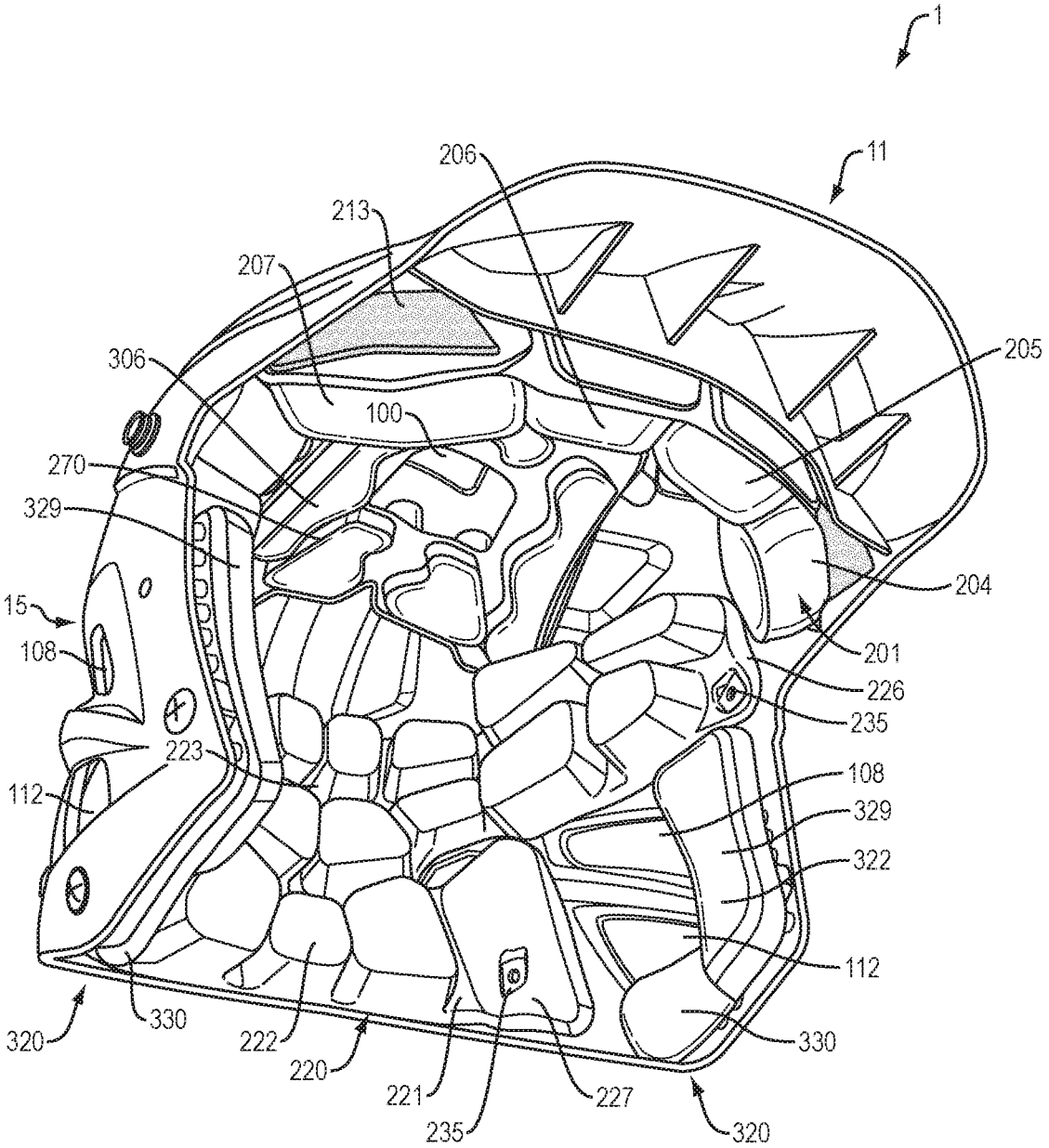
FIG. 9 is a bottom perspective view of the helmet and padding of the subject technology.

Helmet 1 has a full jaw protector 115 attached to shell 10. Jaw protector 115 may be removably attached to shell 10 with screws and T-nuts or may be integrally formed as part of shell 10. Jaw protector 115 extends forwardly from shell 10 to cover and protect the lower jaw of the wearer. As shown in FIGS. 7A, 7B, and 7C, according to an embodiment of the subject technology, jaw protector 115 may have ventilation holes. In the embodiment shown, jaw protector 115 has exactly four ventilation holes 116, 117, 118, 119. Ventilation holes 116, 119 are partially surrounded by acclivities, while ventilation holes 117, 118 are fully surrounded by acclivities. Alternatively, jaw protector 115 may have zero, two, five, or six ventilation holes fully or partially surrounded by acclivities. Top edge 120 of jaw protector 115 may comprise a left curved edge 121, a central curved edge 122, and a right curved edge 123. A central valley 124 partially defined by acclivities may be formed in jaw protector 115. Mounting holes 125, 126 may be formed in jaw protector 115 for mounting to shell 10. Mounting holes 127, 128 may be formed in jaw protector 115 for mounting loop strap connectors. A reinforcing rib or ribs 620 may molded into the inner surface of the central portion of the jaw protector to stiffen and strengthen the central portion of jaw protector 115 against blows during sports play. The inner surface of the central portion of jaw protector 115 could have zero, one, two, three, four, or five ribs.

A faceguard 600 for protecting the face of the wearer and comprised of wire members arranged as a grid may be attached to the shell 10 with straps and/or nuts, as shown. For example, faceguard 600 may be removably attached to shell 10 by loop straps 601, 603 connected by screws, nuts, and/or bolts to shell 10 through holes formed therein. Faceguard 600 may be removably attached to jaw protector 115 by loop straps 602, 604 connected by screws, nuts, and/or bolts to jaw protector 115 through holes formed therein.

Faceguard 600 is a grid of wire members including horizontal wire members and vertical wire members connected together by, for example, welding. The wire members may be composed of steel or titanium. Faceguard 600 may be coated in a plastic or elastomer layer by, for example, dipping.

Figure 27:
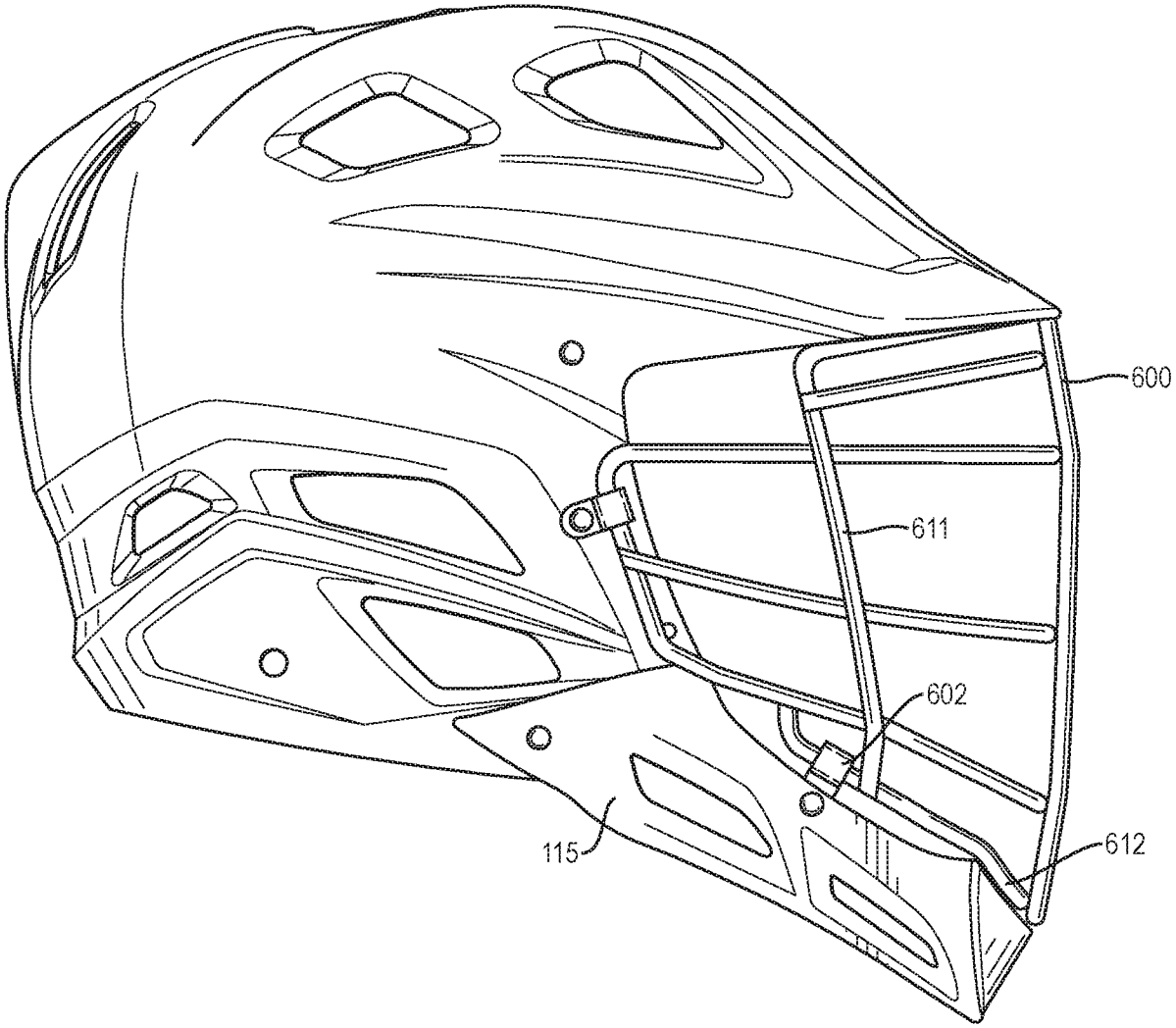
FIG. 27 is a right side view of the shell, jaw protector, and face guard of a sports helmet according to the subject technology.
Figure 28:
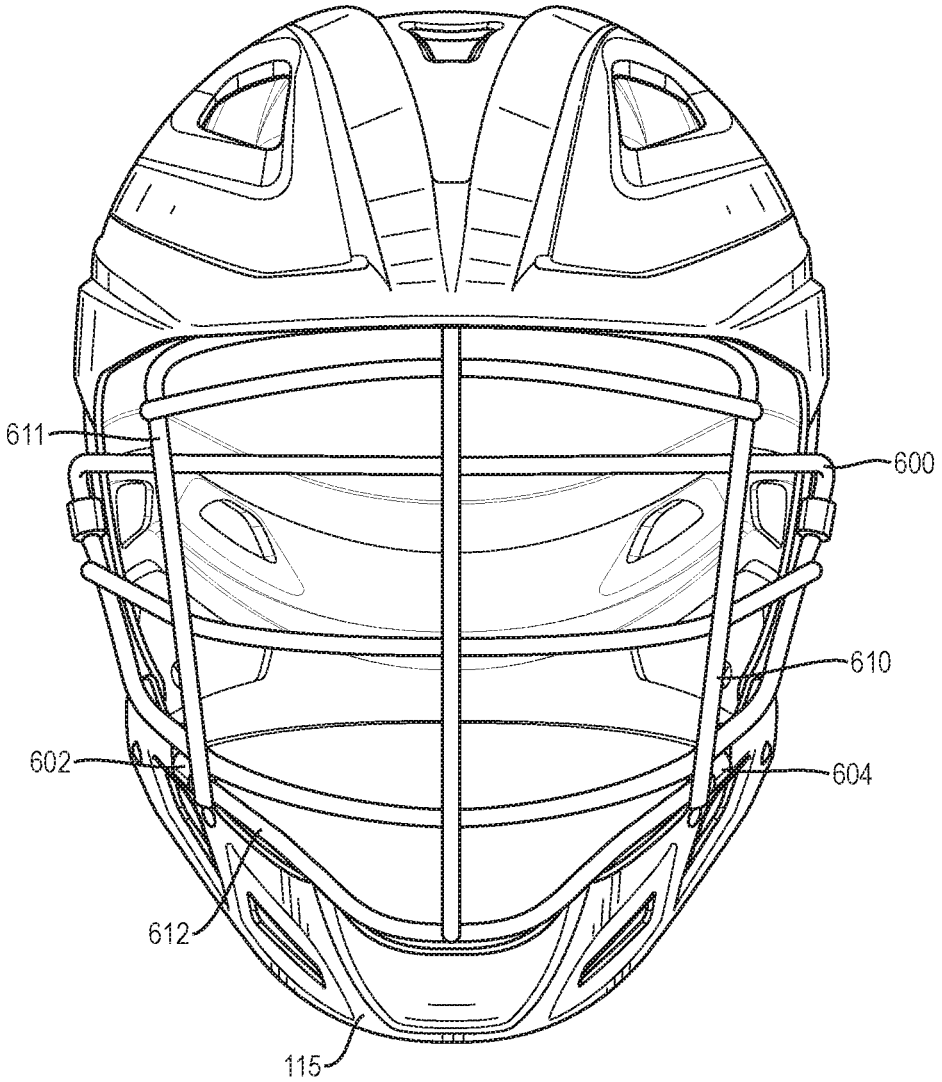
FIG. 28 is a front view of the shell, jaw protector, and face guard of a sports helmet according to the subject technology.
Figure 29:
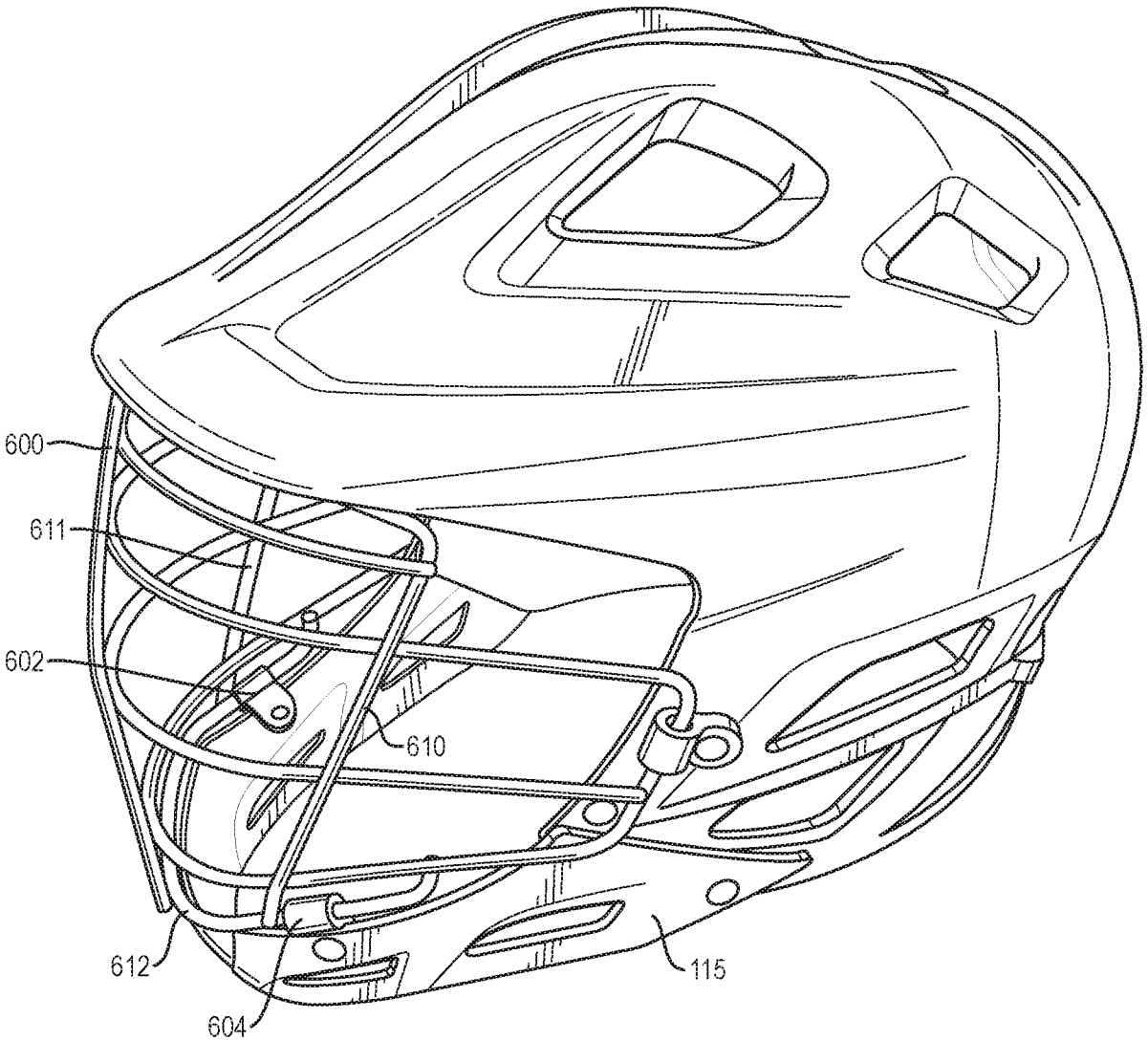
FIG. 29 is a right perspective view of the shell, jaw protector, and face guard of a sports helmet according to the subject technology.

FIGS. 27, 28, and 29 show an alternative embodiment of faceguard 600 in which vertically-extending wire members 610, 611 are joined to bottom wire element 612 at a point forward of loop straps 602, 604 attaching faceguard 600 to jaw protector 115. It has been found that this structure resists the tendency of faceguard 600 to slide and twist when struck with blows during sports play, as loop straps 602, 604 act as stops against rearward movement of vertically-extending wire elements 610, 611.

Figure 30:
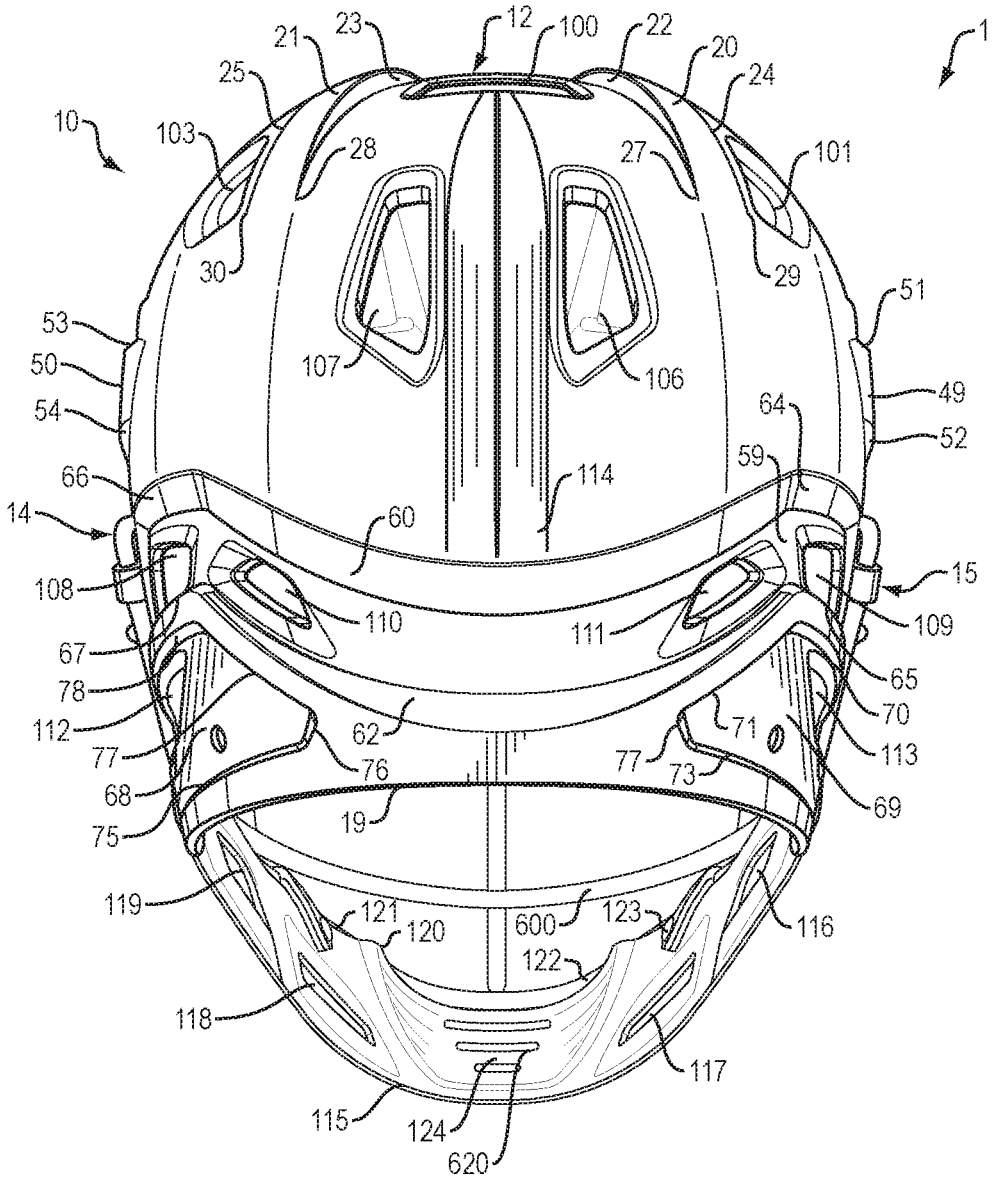
FIG. 30 is a rear view of the shell, jaw protector, and face guard of a sports helmet according to the subject technology.

FIG. 30 shows an alternative embodiment of jaw protector 115 in which a reinforcing rib or ribs are molded into the inner surface of the central portion of the jaw protector. FIG. 30 shows three horizontal ribs 620. In alternative embodiments, the inner surface of the central portion of jaw protector 115 could have one, two, four, or five ribs. The rib or ribs stiffen and strengthen the central portion of jaw protector 115 against blows during sports play.

II. Helmet Padding (First Alternative)

Helmet 1 is provided with padding assemblies mounted to the inner surface of shell 10 for shock absorption, to cushion blows sustained to the helmet 1 during sporting play, to size the helmet to the wearer, and to provide comfort for the wearer. The padding assemblies are advantageously removably mounted to the inner surface of shell 10 to enable replacement of worn padding, and to enable the use of padding of different sizes to custom-fit the helmet to the wearer. The padding assemblies may be removably attached to the shell by hook-and-loop fasteners or by assemblies of screws and T-nuts passing through holes formed in shell 10, as hereinafter described.

As shown in FIGS. 8-20 and as hereinafter described, helmet 1 may be provided with padding comprising front liner 201, lateral liner 220, inflatable occipital pad 240, crown shock absorber 270, and jaw pads 280, 290.

Figure 10A:
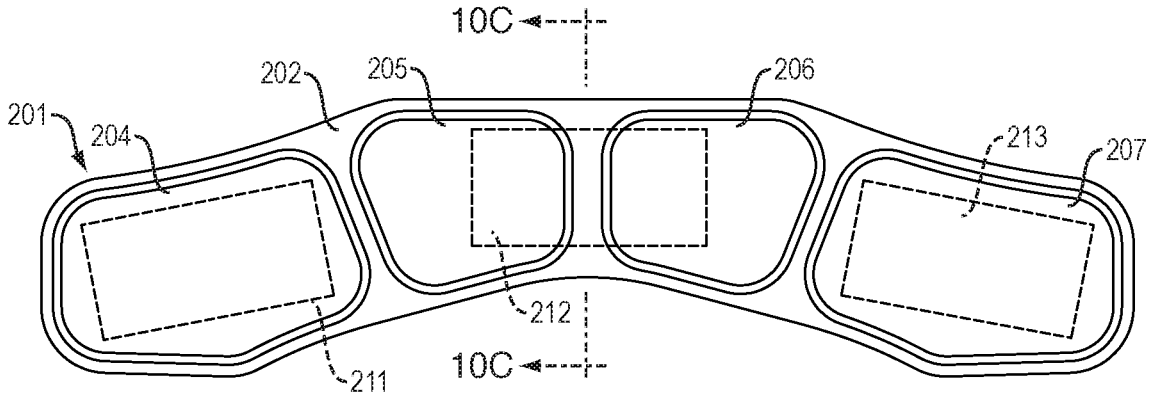
FIG. 10A is a front view of the front liner of a sports helmet according to the subject technology.
Figure 10B:
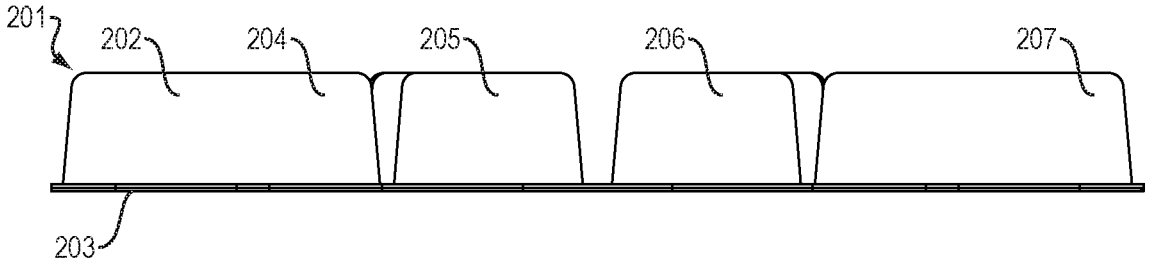
FIG. 10B is a bottom view of the front liner of a sports helmet according to the subject technology.
Figure 10C:
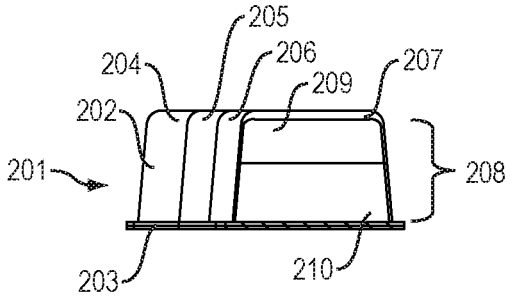
FIG. 10C is a cross-sectional view of the front liner of a sports helmet according to the subject technology along line A-A.

Turning to FIGS. 10A, 10B and 10C, front liner 201 is removably attached to the inner surface of shell 10 by hook-and-loop fasteners above the top front edge to generally partially overlie the brow area of the wearer. Front liner 201 is comprised of a top sheet 202 and a bottom sheet 203, both sheets consisting of a durable, smooth, substantially non-porous material such as thermoplastic polyurethane, the sheets being bonded together. Top sheet 202 may have a thickness of 0.035 inches or approximately 0.035 inches. Bottom sheet 203 may have a thickness of 0.025 inches or approximately 0.025 inches. Pockets 204, 205, 206, 207 are formed in top sheet 202 for containing shock absorbing foam pads 208. Four pockets are shown in FIGS. 10A, 10B and 10C, but alternatively front liner 201 could be formed with one, two, three, five, or six pockets. Advantageously, shock absorbing foam pads 208 could be formed as two layers of different foam material as shown in FIG. 10C. Inner layer 209 may be composed of a relatively soft, but still energy-absorbing, foam material to improve comfort. Suitable materials for inner layer 209 include Omalon® foam, available from Carpenter Co. of Richmond, Va. Base layer 210 may be composed of an energy-absorbing foam. Suitable materials for base layer 210 include ethylene vinyl acetate foams such as those sold under the Cell-Flex brand by the DER-TEX Corporation of Saco, Me. Cell-Flex VN 1000 is suitable for use in base layer 210. Hook-and-loop fasteners are bonded to bottom sheet 203 at the locations indicated by phantom lines 211, 212, 213 for attaching front liner 201 to the inner surface of shell 10.

Figure 11:
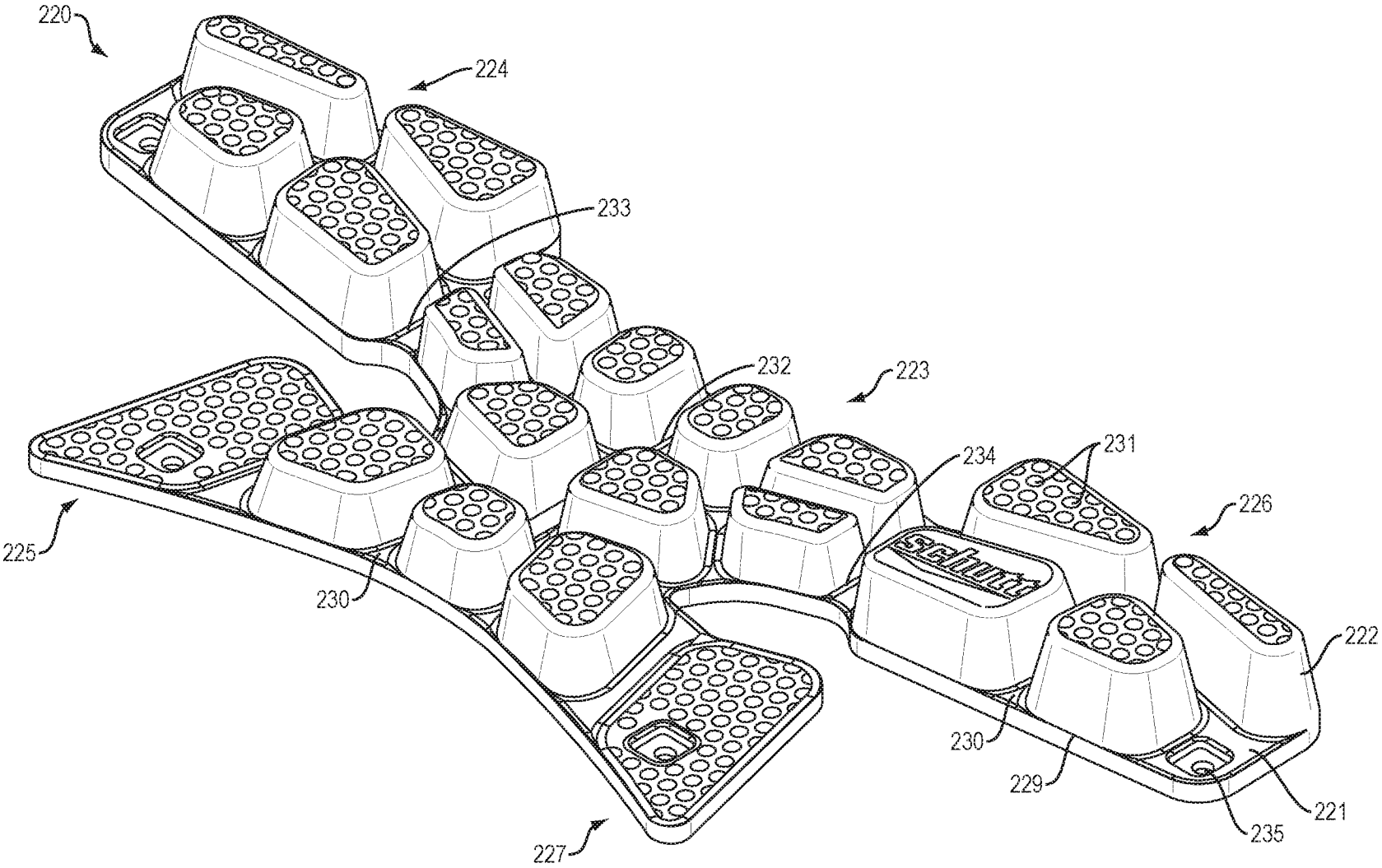
FIG. 11 is a perspective view of the lateral liner of a sports helmet according to the subject technology.
Figure 12A:
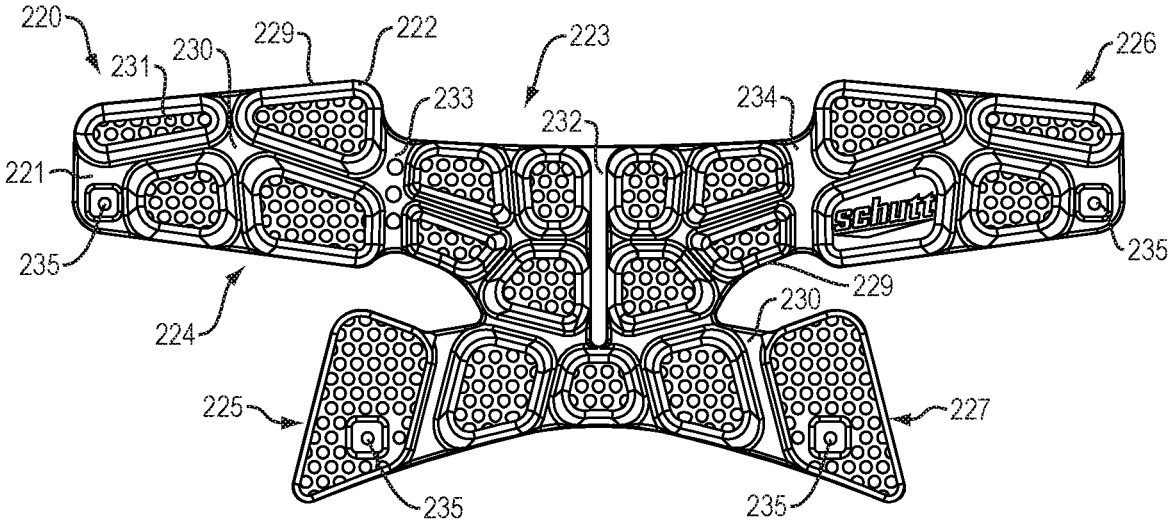
FIG. 12A is a front view of the lateral liner of a sports helmet according to the subject technology.
Figure 12B:
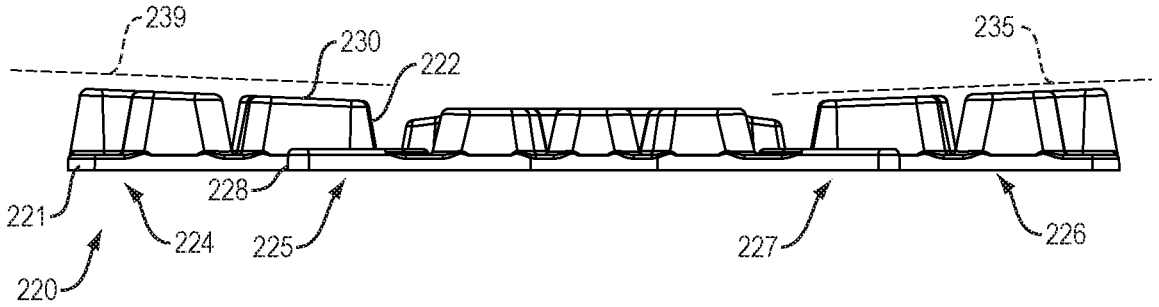
FIG. 12B is a bottom view of the lateral liner of a sports helmet according to the subject technology.

Turning now to FIGS. 11, 12A, and 12B, lateral liner 220 is removably attached to the inner surface of shell 10 and generally at least partially overlies the occipital area, i.e. the occipital bone and adjacent skull structures of the wearer. Lateral liner 220 may be formed out of a flexible foam padding material, shock foam, or the like. Preferably, lateral liner 220 is formed from a flexible, rate-sensitive shock absorbing material. A suitable rate-sensitive shock absorbing material is available under the trade name D3O® from D3O Lab of Brighton, East Sussex BN41 1DH, UK. Lateral liner 220 may be formed by molding. Lateral liner 220 comprises base layer 221 and a plurality of pads 222 (only one is numbered) integrally formed with base layer 221. Lateral liner 220 may have a fabric backing of flocked material.

Lateral liner 220 comprises central region 223, upper right wing 224, lower right wing 225, upper left wing 226, lower left wing 227. Wings 224, 225, 226, 227 are integrally formed and connected with central region 223 by common base layer 221. Lateral liner 220 is backed by a woven, inelastic fabric layer 228 bonded to base layer 221. Layer 228 may be formed of tricot or the like. Each of pads 222 may taper from a relatively wide base 229 to a relatively narrow plateau 230 and are closely spaced in their distribution across base layer 221 for good shock protection. Plateaus 230 may be textured by dimpling 231 or by pebbling or crosshatching. Upper wings 224, 226 are shown as having four pads 222, but could have one, two, three, five, or six pads. Lower wings 225, 227 are shown as having one pad 222, but could have two, three, four, or five pads. Central region 223 comprises an upper central region 229 and a lower central region 230. Upper central region 229 is shown as having eight pads, but could have two, four, or six pads. Lower central region 230 is shown as having three pads, but could have one, two, four, five, or six pads.

Upper central region 229 is bisected by a living hinge section 232 of base layer 221, the section 232 being free of pads to permit flexure of lateral liner 220 about the hinge. Similarly, upper wings 224, 226 are divided from central region 223 by living hinge sections 233, 234 of base layer 221, the sections 232, 234 being free of pads to permit flexure of lateral liner 220 about the hinges. The plateaus 230 of pads 222 of upper wings 224, 226 are sloped along a common line 239 with respect to base layer 221, the slope being toward a center line of lateral liner 220, to better conform the liner 220 to the shape of the wearer's head.

The thickness of lateral liner 220 in central region 223 (including base layer 221 and pads 222) may be approximately 1 inch. The thickness of lateral liner 220 in upper wings 224, 226 (including base layer 221 and pads 222) at the edge of pads 222 furthest away from the center line of lateral liner 220 could be approximately 1.32 inches. The thickness of lateral liner 220 in lower wings 225, 227 (including base layer 221 and pads 222) may be approximately 0.25 inches.

Lateral liner 220 may be removably attached to shell 10 by means of male snap screws passing through holes formed in shell 10 and corresponding holes 235 formed in wings 224, 225, 226, 227 of lateral liner 220, and retained by T-nuts. The male snap screws may serve as connection points for a chin strap.

Turning now to FIGS. 13A, 13B, 14A, 14B, 15A, 15B, and 15C inflatable occipital pad 240 may be positioned behind occipital shock absorber 220, i.e., between occipital shock absorber 220 and the inner surface of shell 10. The shell 10 in the area of the inflatable occipital pad 240 may have a thickness of between 0.11 inches to 0.14 inches, or 0.11 inches to 0.135 inches, or 0.11 inches to 0.13 inches. Inflation of inflatable occipital pad 240 pushes the occipital shock absorber 220 forward thus adjusting the size of the helmet to the wearer.

Figure 13A:
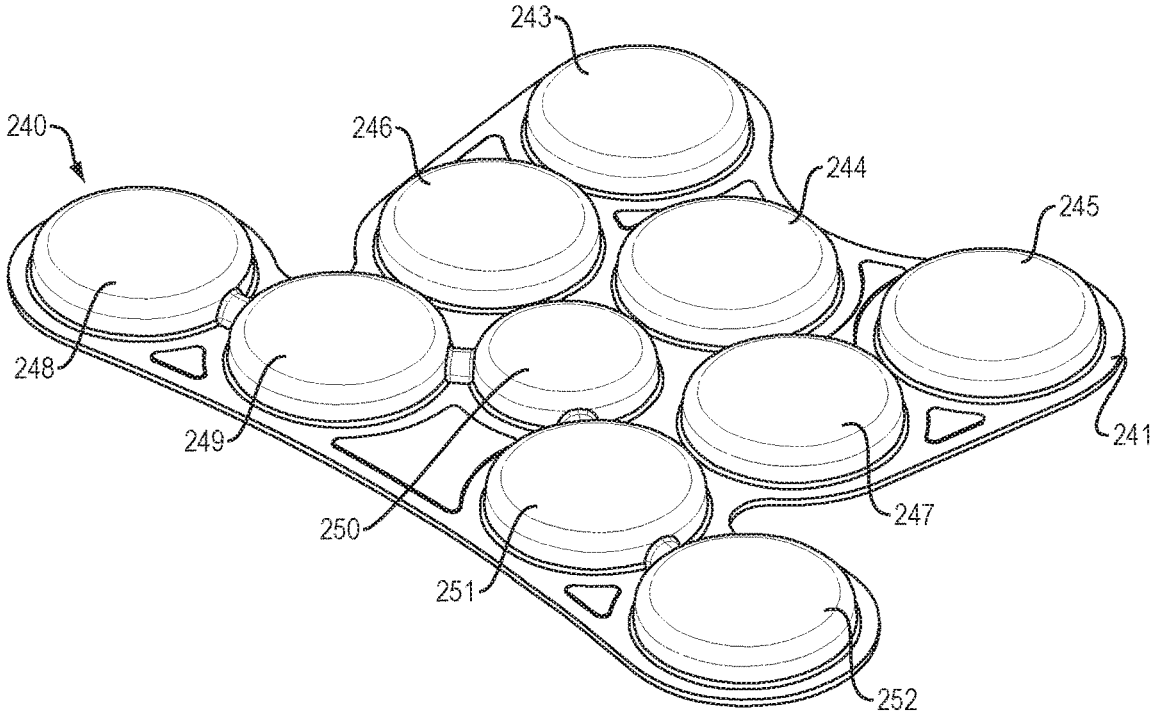
FIG. 13A is a perspective view of the inflatable occipital pad of the subject technology.
Figure 13B:
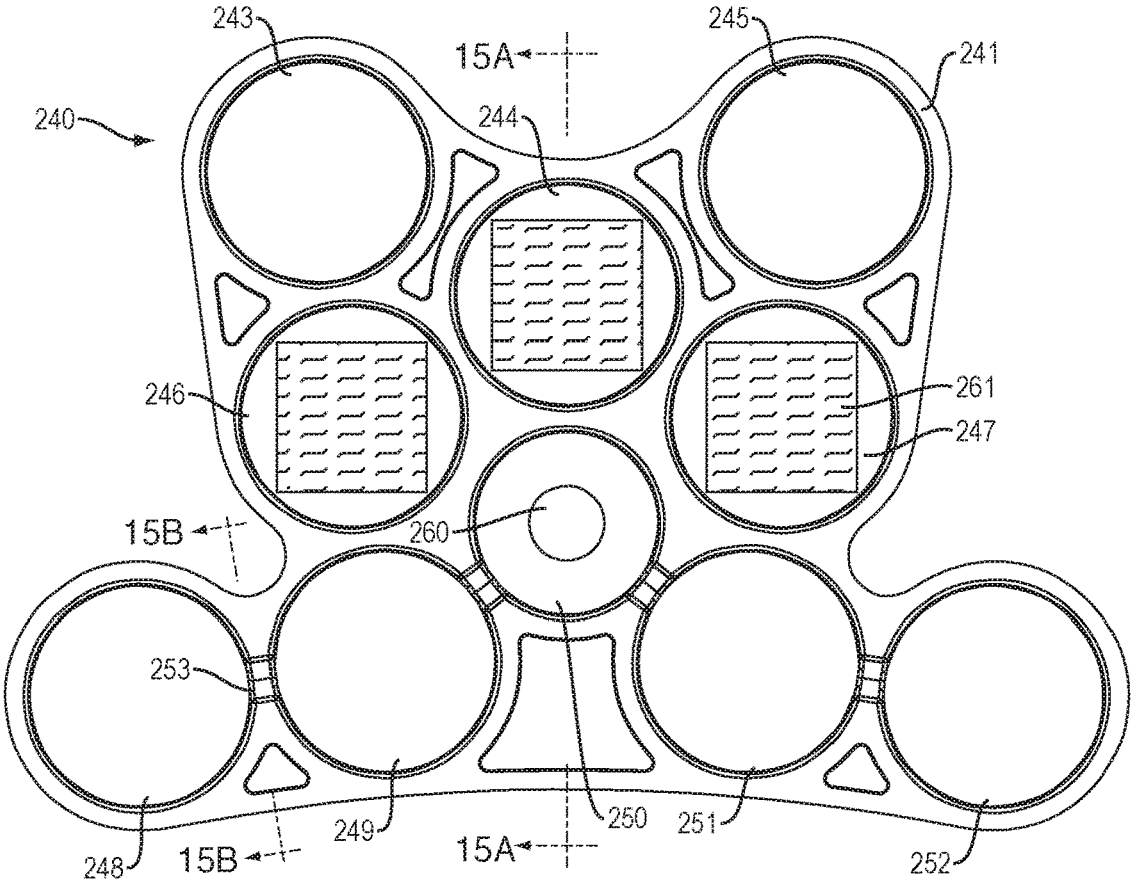
FIG. 13B is a front view of the inflatable occipital pad of the subject technology.
Figure 14A:
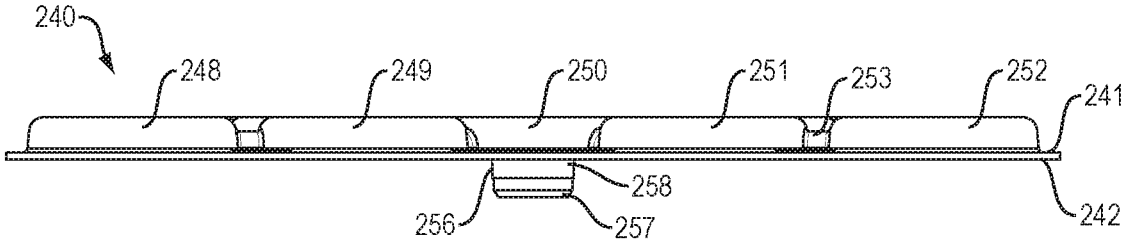
FIG. 14A is a side view of the inflatable occipital pad of the subject technology.
Figure 14B:
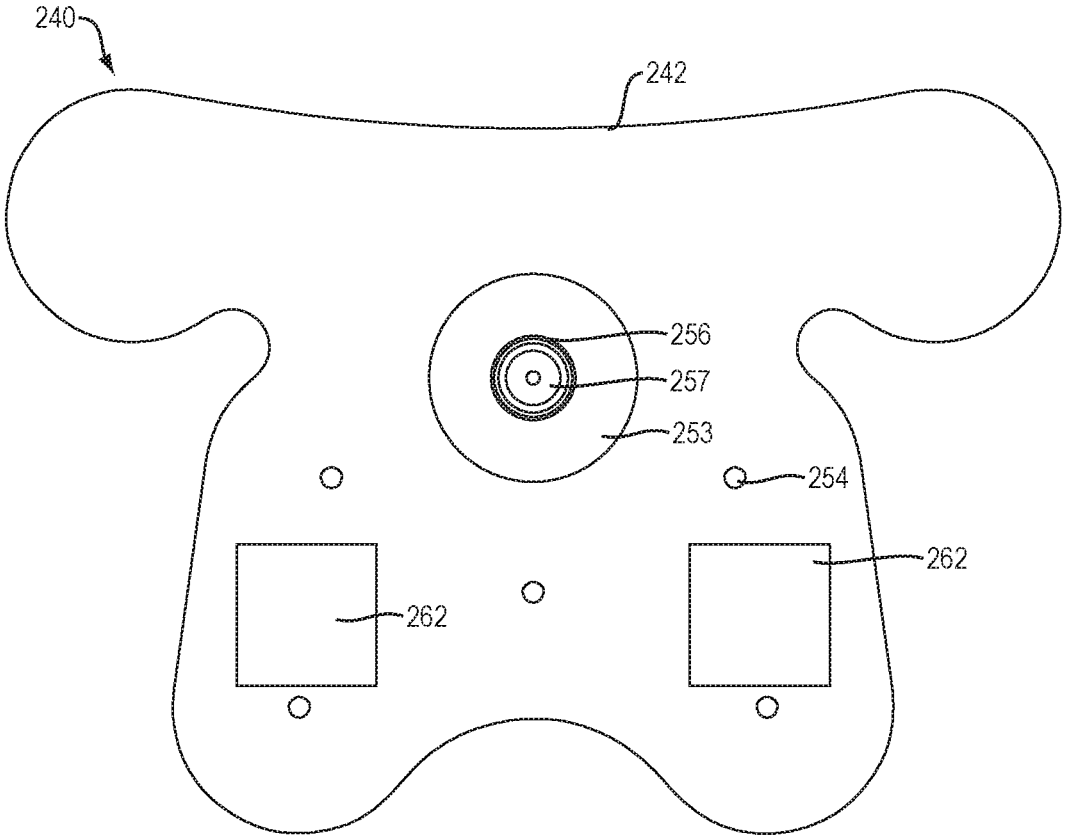
FIG. 14B is a rear view of the inflatable occipital pad of the subject technology.
Figure 15A:
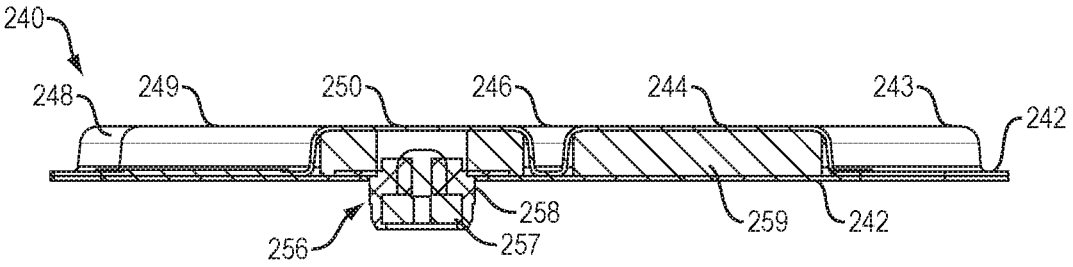
FIG. 15A is a cross-sectional view of the inflatable occipital pad of the subject technology of FIG. 13B along line A-A.
Figure 15B:
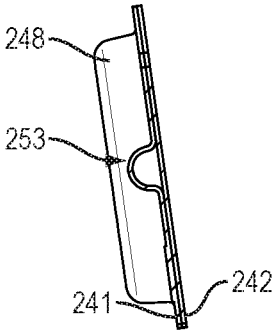
FIG. 15B is a cross-sectional view of the inflatable occipital pad of the subject technology of FIG. 13B along line B-B.
Figure 15C:
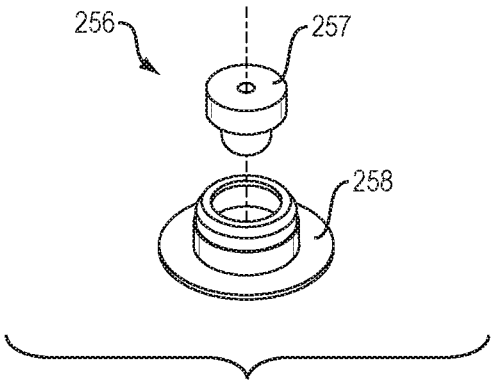
FIG. 15C is a exploded view of the valve assembly of the inflatable occipital pad of the subject technology.
Figure 16B:
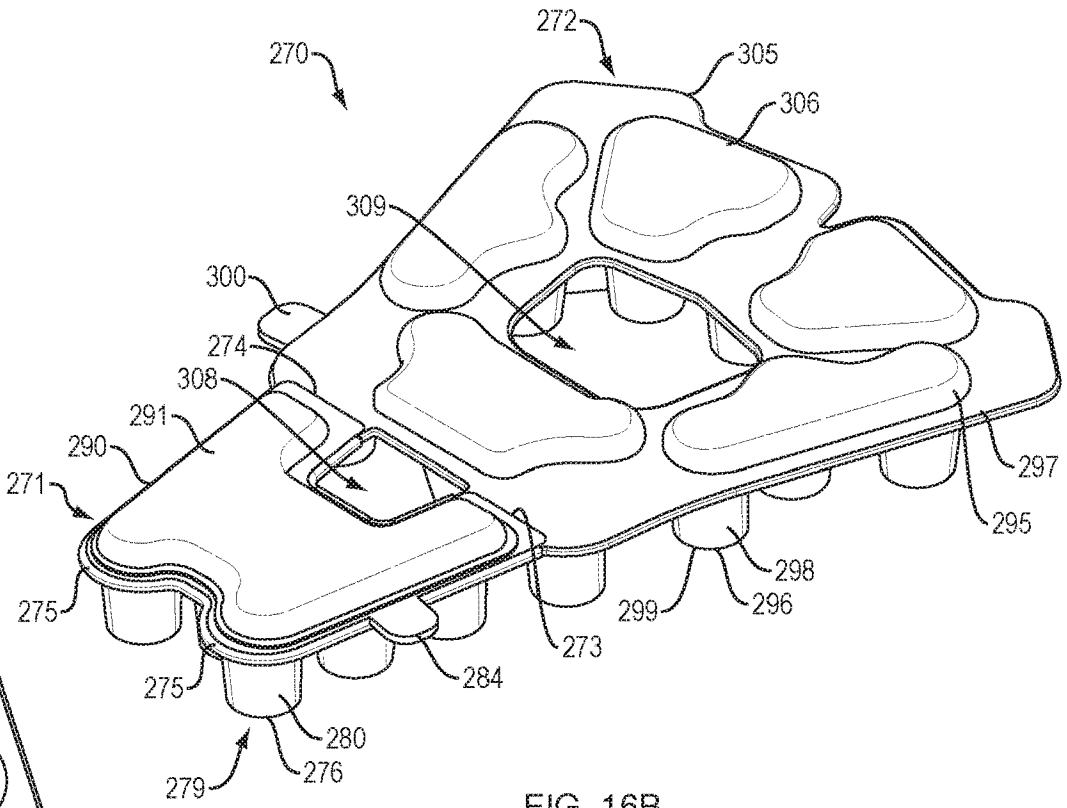
FIG. 16B is a perspective view of a crown shock absorber of the subject technology.
Figure 16A:
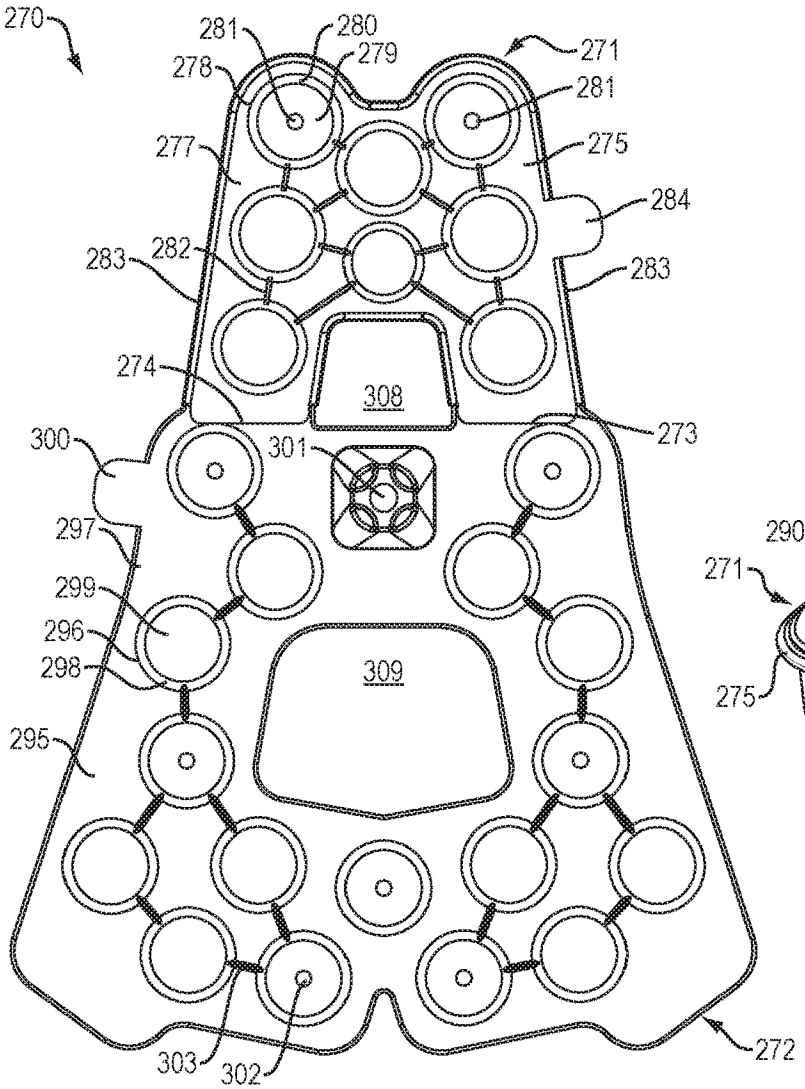
FIG. 16A is a top view of the crown shock absorber of the subject technology.
Figure 17B:
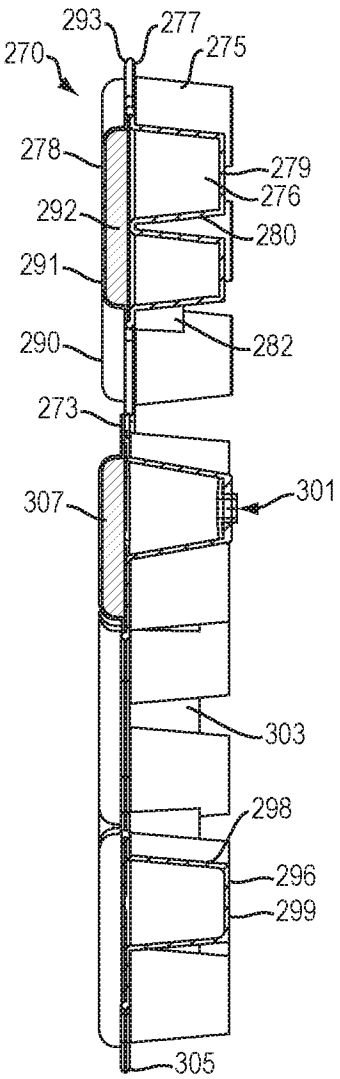
FIG. 17B is a cross sectional view of the crown shock absorber of FIG. 17A along line D-D.
Figure 17A:
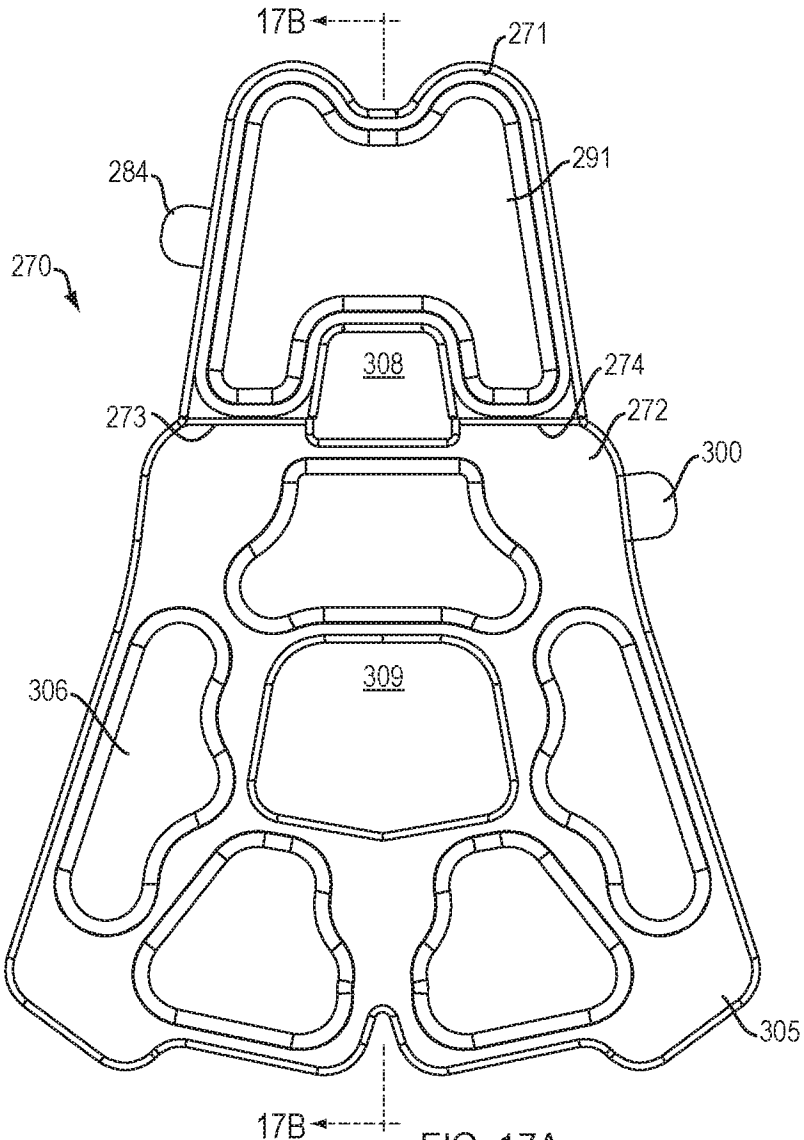
FIG. 17A is a bottom view of the crown shock absorber of the subject technology.
Figure 18A:
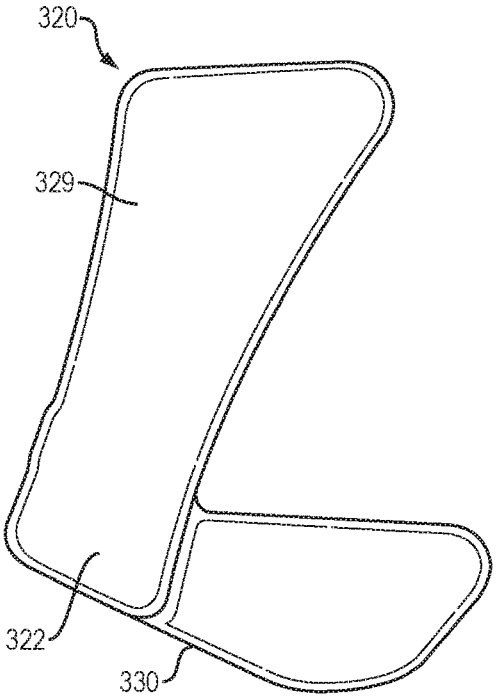
FIG. 18A is a front view of a jaw pad of the subject technology.
Figure 18B:
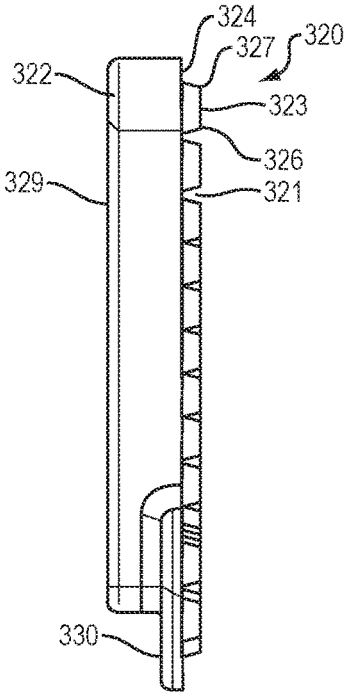
FIG. 18B is a side view of a jaw pad of the subject technology.
Figure 18C:
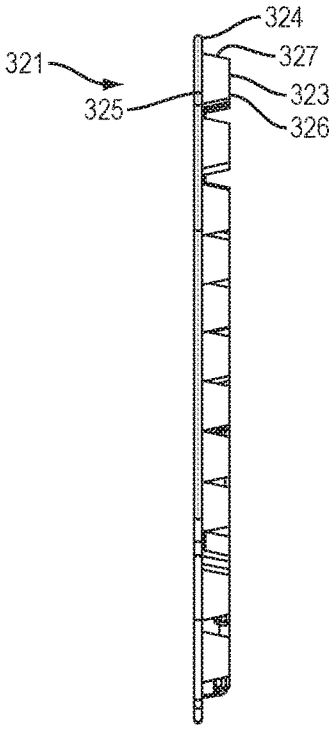
FIG. 18C is a side view of a shock absorbing layer of a jaw pad of the subject technology.
Figure 18D:
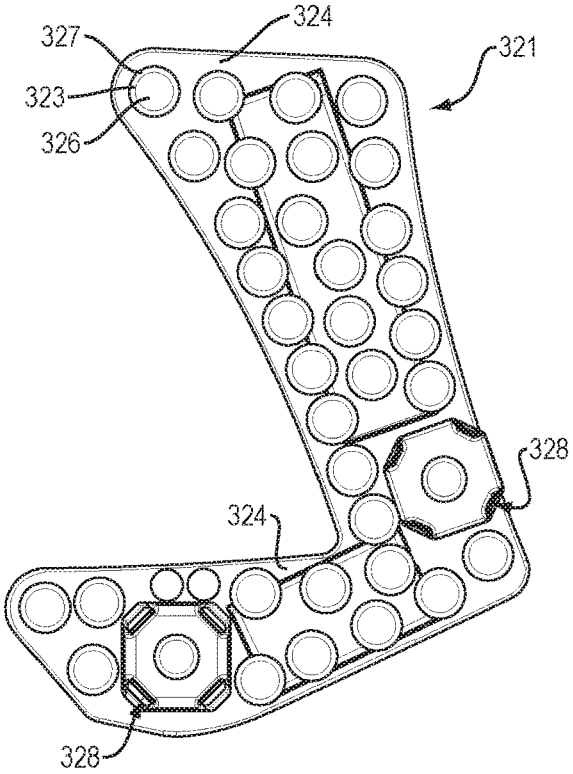
FIG. 18D is a rear view of a shock absorbing layer of a jaw pad of the subject technology.

Inflatable occipital pad 240 is comprised of a top sheet 241 and a bottom sheet 242, both sheets consisting of a durable, smooth, substantially nonporous material such as vinyl, the sheets being bonded together. Top sheet 241 and bottom sheet 242 may have a thickness of 0.025 inches or approximately 0.025 inches. Pockets 243, 244, 245, 246, 247, 248, 249, 250, 251, 252 are formed in top sheet 241. As shown in FIG. 13B, the occipital pad includes a central inflatable pocket 250 with left and right side inflatable pockets 248, 249, 251, and 252. The left and right side inflatable pockets are separated by respective gaps from the central inflatable pocket best seen in FIGS. 13A and 13B. As further shown in FIG. 13B, the left and right side pockets are in serial fluid connection with the central inflatable pocket and extend in a series to the left and right of the central inflatable pocket. Pockets 243, 244, 245, 246, 247 are isolated from the other pockets and are not inflatable. As shown in FIG. 13B, the non-inflatable pockets 244, 246, and 247 surround the central inflatable pocket. Pockets 243, 244, 245, 246, 247 may contain pads made of shock absorbing foam. Cell-Flex VN 1000 is suitable for this purpose. The pads may have a thickness in the range of 0.25 inches to 0.375 inches. Pockets 243, 244, 245, 246, 247 may have holes e.g. 254 formed in bottom sheet 242 for permitting the passage of air out of the pockets.

Pockets 248, 249, 250, 251, 252 are fluidly connected to their neighbors through channels e.g. 253 formed in top sheet 241. Pockets 248, 249, 250, 251, 252 are inflatable as hereinafter described, and may also contain foam pads e.g. 259 made of shock absorbing foam such as Cell-Flex VN 1000. Pockets 248, 249, 250, 251, 252 are inflatable through valve assembly 256 comprised of valve 257 and valve housing 258. Valve assembly 256 may be placed in pocket 250, sealed to bottom sheet 242 and protruding through a corresponding hole in bottom sheet 242. Pockets 248, 249, 250, 251, 252 are inflatable through valve 257 using a needle pump as is known in the art. A vinyl disc 260 may be bonded to pocket 250 in top sheet 241.

Hook-and-loop fasteners are bonded to inflatable occipital pad 240 for attaching it to the inner surface of shell 10. Rectangular hook-and-loop pads 262 are bonded to bottom sheet 242. Annular hook-and-loop pad 263 is bonded to bottom sheet 242 surrounding the protrusion of valve assembly 257 from pocket 250. Corresponding hook-and-loop pads are mounted on the inner surface of shell 10 for mating with pads 262 and 263. Additional hook-and-loop pads may be provided on top sheet 241, e.g. 247, for mating with the flocked backing of occipital shock absorber 220.

Turning now to FIGS. 16A, 16B, 17A, and 17B crown shock absorber 270 comprises a front portion 271 and a rear portion 272, hingedly attached by living hinges 273, 274. Each of front portion 271 and rear portion 272 comprises a shock absorbing layer, a barrier layer, an outer layer, and pads, as hereinafter described. Living hinges 273, 274 may be formed by bonding front portion 271 and a rear portion 272 along a margin of contact which allows for some flexibility of the assembly about the line of the hinges. The flexibility of crown shock absorber 270 about living hinges 273, 274 allows the assembly to approximately conform to the curvature of the inner surface of shell 10.

Front portion 271 of crown shock absorber 270 of comprises front shock absorbing layer 275, which is advantageously formed from thermoplastic urethane ("TPU"). Protective arrangements for helmets formed of injection molded TPU parts are disclosed in U.S. Pat. No. 8,069,498, and the TPU layers of the crown shock absorber and jaw pads of the subject technology may be constructed as in that patent, the entirety of which is incorporated by reference. Suitable TPU material is available from Bayer. Layer 275 may be fabricated by injection molding. Layer 275 has a generally trapezoidal coverage area. Layer 275 has a plurality of spaced-apart projecting hollow protrusions 276 protruding from a base sheet 277 and distributed over the coverage area. Each protrusion 276 has an open, preferably circular larger diameter base 278 at the sheet 277 from which it extends, and a smaller diameter, preferably flat circular peak 279, and a preferably curved or straight frustoconical side wall 280 that tapers from the open base 278 to the closed peak 279. A circular peak may be formed with a peak opening 281 therein. Ribs 282 may be integrally formed in sheet 277 extending between adjacent protrusions 276. Each side wall 280 is collapsible for absorbing shocks which may be transmitted to each protrusion 276. The protrusions 276 are spaced apart from each other for distributing the shock-absorbing effects of the protrusions 276 over the coverage area of front portion 271. The protrusions 276 located on the lateral sides 283 of front portion 271 are somewhat taller (i.e., their sidewalls are somewhat longer by a first distance) than the protrusions in the center of front portion 271 and will be compressed first during a shock, before the protrusions 276 in the center, to better distribute the shock across the coverage area. The height of the taller protrusions 276 located on the lateral sides 283 may be 0.86 inches or approximately 0.86 inches. The height of the shorter protrusions 276 may be 0.795 inches or approximately 0.795 inches. The thickness of base sheet 277, side walls 280, peaks 279, may be 0.04 inches or approximately 0.04 inches. Tab 284 may be integrally formed with base sheet 277 for ease in manipulating and positioning crown shock absorber 270.

Front portion 271 of crown shock absorber 270 further comprises outer layer 290. Outer layer 290 is a is a thin sheet of durable, smooth, substantially non-porous material such as TPU. Outer layer 290 have a thickness of 0.025 inches or approximately 0.025 inches. A pocket 291 is formed in outer layer 290 containing pad 292. Pad 292 is a foam material, preferably a shock absorbing foam material, more preferably a slow-rebound, very firm foam material. A suitable material for pad 292 is Poron, a urethane foam material available from Rogers Corporation, One Technology Drive, Rogers, Conn. Pad 292 is preferably shaped and sized to substantially fill pocket 291 in outer layer 290. Pad 292 may be 6 mm or approximately 6 mm thick. Alternatively, pad 292 may be composed of two pads 3 mm or approximately 3 mm thick.

Front portion 271 of crown shock absorber 270 further comprises barrier layer 293. Barrier layer 293 is a thin sheet of durable, smooth, substantially non-porous material such as TPU. Barrier layer 293 may have a thickness of 0.025 inches or approximately 0.025 inches. Barrier layer 293 is sandwiched between outer layer 290 and front shock absorbing layer 275, and all three elements are sealed together. Barrier layer 293 seals pocket 291 formed in outer layer 290.

Rear portion 272 of crown shock absorber 270 is constructed similarly to front portion 271. Front portion 271 of crown shock absorber 270 of comprises rear shock absorbing layer 295, which is advantageously formed from thermoplastic urethane ("TPU"). Suitable TPU material is available from Bayer. Layer 295 may be fabricated by injection molding. Layer 295 has a generally trapezoidal coverage area. Layer 295 has a plurality of spaced-apart projecting hollow protrusions 296 protruding from a base sheet 297 and distributed over the coverage area, as in front portion 271. Protrusions 296 have side walls 298 and peaks 299, and may have peak openings 302 as in protrusions 276 of front portion 271. Ribs 303 may be integrally formed in base sheet 297 connecting adjacent projections 296. The thickness of base sheet 297, side walls 298, peaks 299, may be 0.04 inches or approximately 0.04 inches. Tab 300 may be integrally formed with base sheet 297 for ease in manipulating and positioning crown shock absorber 270. A T-nut 301 may be fixed in a centrally-located projection for attaching crown shock absorber 270 to the inner surface of shell 10.

Rear portion 272 of crown shock absorber 270 further comprises outer layer 305. Outer layer 305 is a is a thin sheet of durable, smooth, substantially non-porous material such as TPU. Outer layer 305 may have a thickness of 0.025 inches or approximately 0.025 inches. A plurality of pockets 306 (only one is numbered in the figures) are formed in outer layer 305 for containing pads 307. Pads 307 are comprised of a foam material, preferably a shock absorbing foam material, more preferably a slow-rebound foam material. A suitable material for pads 307 is Omalon® foam, available from Carpenter Co. of Richmond, Va. Pads 307 are preferably shaped and sized to substantially fill pockets 306 in outer layer 305. Pads 307 may be 6 mm or approximately 6 mm thick.

Rear portion 272 of crown shock absorber 270 further comprises barrier layer 308. Barrier layer 308 is a thin sheet of durable, smooth, substantially non-porous material such as TPU. Barrier layer 308 may have a thickness of 0.025 inches or approximately 0.025 inches. Barrier layer 308 is sandwiched between outer layer 305 and rear shock absorbing layer 295, and all three elements are sealed together. Barrier layer 308 seals pockets 306 formed in outer layer 305.

Front portion 271 and rear portion 272 of crown shock absorber 270 may each be shaped to define ventilation opening 308 therebetween. Rear portion 272 may also have a ventilation opening 309 defined therein. Ventilation openings 308, 309 may be shaped and positioned to register with ventilation holes 100, 105 in central valley 31 of shell 10 such that ventilation is provided through shell 10 and through crown shock absorber 270 to the wearer.

Turning now to FIGS. 18A, 18B, 18C, and 18D, each of jaw pads 320 is an approximately L-shaped assembly comprising a jaw shock absorbing layer 321 and a cushion layer 322. A left jaw pad is shown in FIGS. 17A, 17B, 17C, and 17D, but it will be understood that right and left jaw pads are similar in construction. Jaw shock absorbing layer 321 is advantageously formed from thermoplastic urethane ("TPU"). Suitable TPU material is available from Bayer. Layer 321 may be fabricated by injection molding. Layer 321 has a generally L-shaped coverage area. Layer 321 has a plurality of spaced-apart projecting hollow protrusions 323 protruding from a base sheet 324 and distributed over the coverage area. Each protrusion 323 has an open, preferably circular larger diameter base 325 at the sheet 324 from which it extends, a smaller diameter, preferably flat circular peak 326, and a preferably curved or straight frustoconical side wall 327 that tapers from the open base 325 to the closed peak 326. The protrusions are closely spaced to provide good shock absorption. T-bolts 328 may be retained in certain protrusions 323 of jaw shock absorbing layer 321 for attaching the jaw pad assembly to the inner surface of shell 10.

Cushion layer 322 may be formed of a foam material such as ethylene vinyl acetate foams, for example, those sold under the Cell-Flex brand by the DER-TEX Corporation of Saco, Me. Cushion layer 322 is approximately L-shaped to overlay jaw shock absorbing layer 321 and may be slightly larger than jaw shock absorbing layer 321. Cushion layer 322 may be attached to shock absorbing layer 321 by hook-and-loop fasteners. For this purpose, cushion layer 322 may be backed by a fabric material bonded to the side of cushion layer 322 contacting jaw shock absorbing layer 321, to which may be bonded the hook pads 324 of a hook-and-loop fastener bonded to the base sheet 324 of layer 321. Cushion layer 322 may be integrally composed of a thick portion 329 and a thin portion 330, the thin portion forming the base of the L-shape. Cushion layer 322 may be provided in different thicknesses to accommodate different wearers and better size the helmet to the wearer. More particularly, the helmet may be provided with a kit of differently-sized cushion layers so that the helmet may be fitted to the wearer by selecting an appropriately-sized cushion layer 322. Sizes for the thick portion 329 and thin portion 330 of cushion layer 322 may be as follows, in inches: 0.60 and 0.15; 0.48 and 0.15; 0.35 and 0.15; 0.75 and 0.30.

Alternatively, the jaw pads could be constructed as in U.S. Pat. No. 8,201,269, the entirety of which is incorporated by reference.

III. Helmet Padding (Second Alternative)

Figure 19:
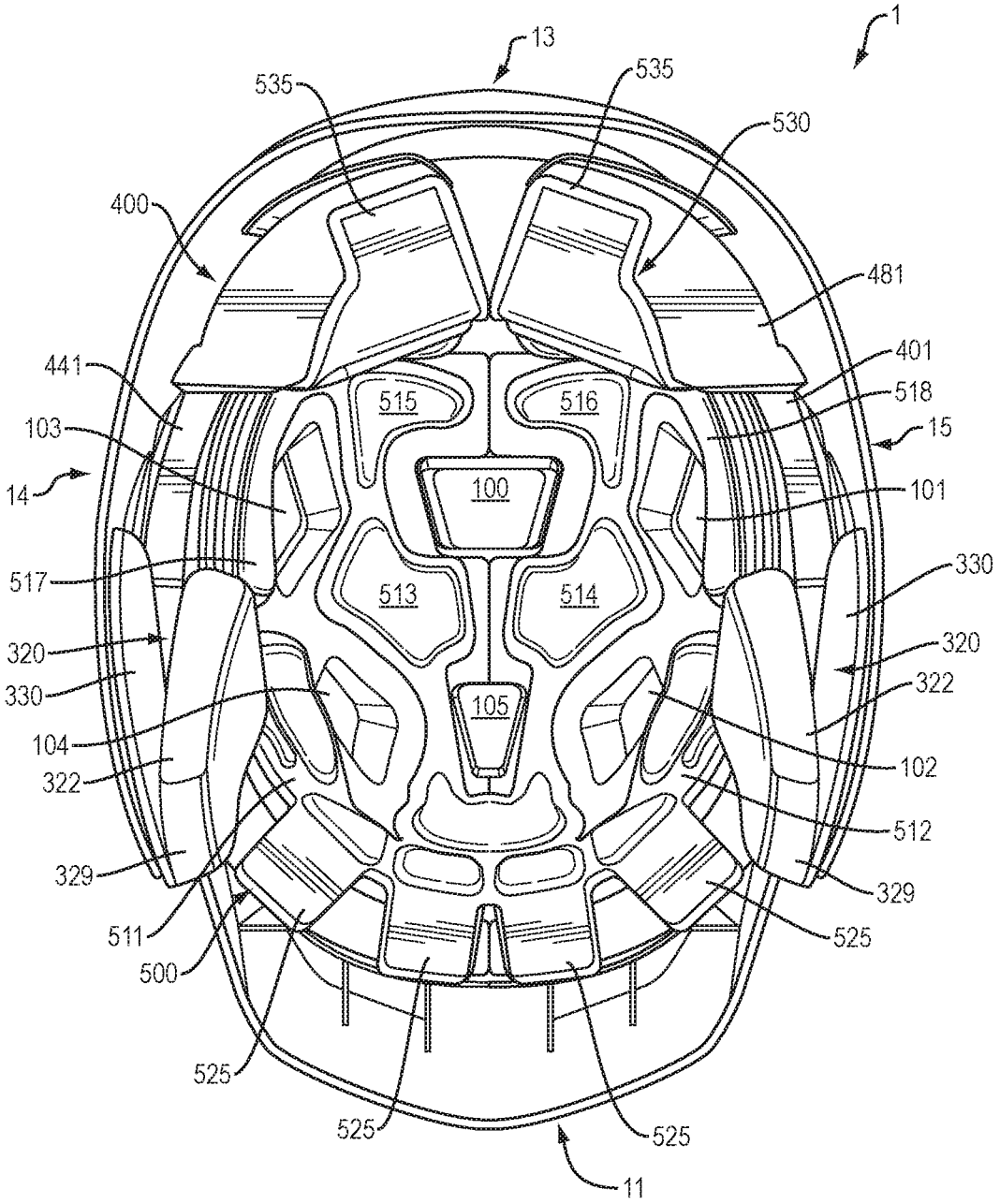
FIG. 19 is a bottom view of the helmet and second alternative padding of the subject technology.
Figure 20:
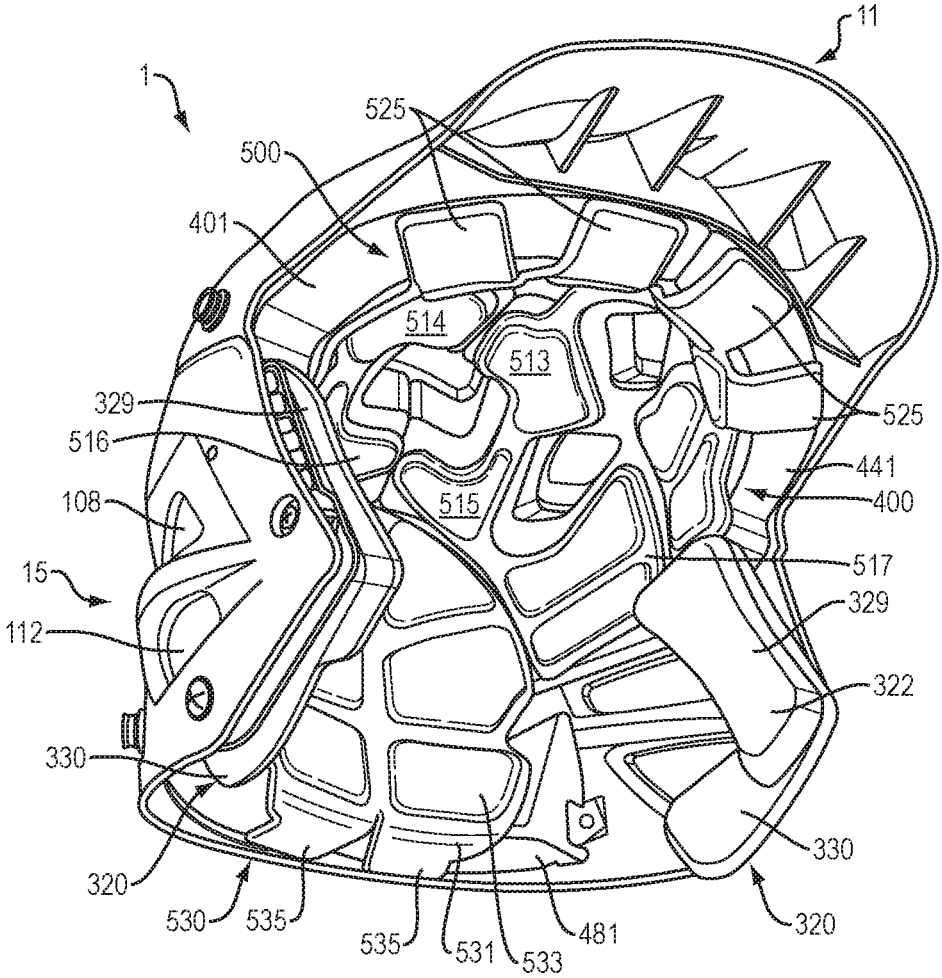
FIG. 20 is a bottom perspective view of the helmet and second alternative padding of the subject technology.
Figure 21A:
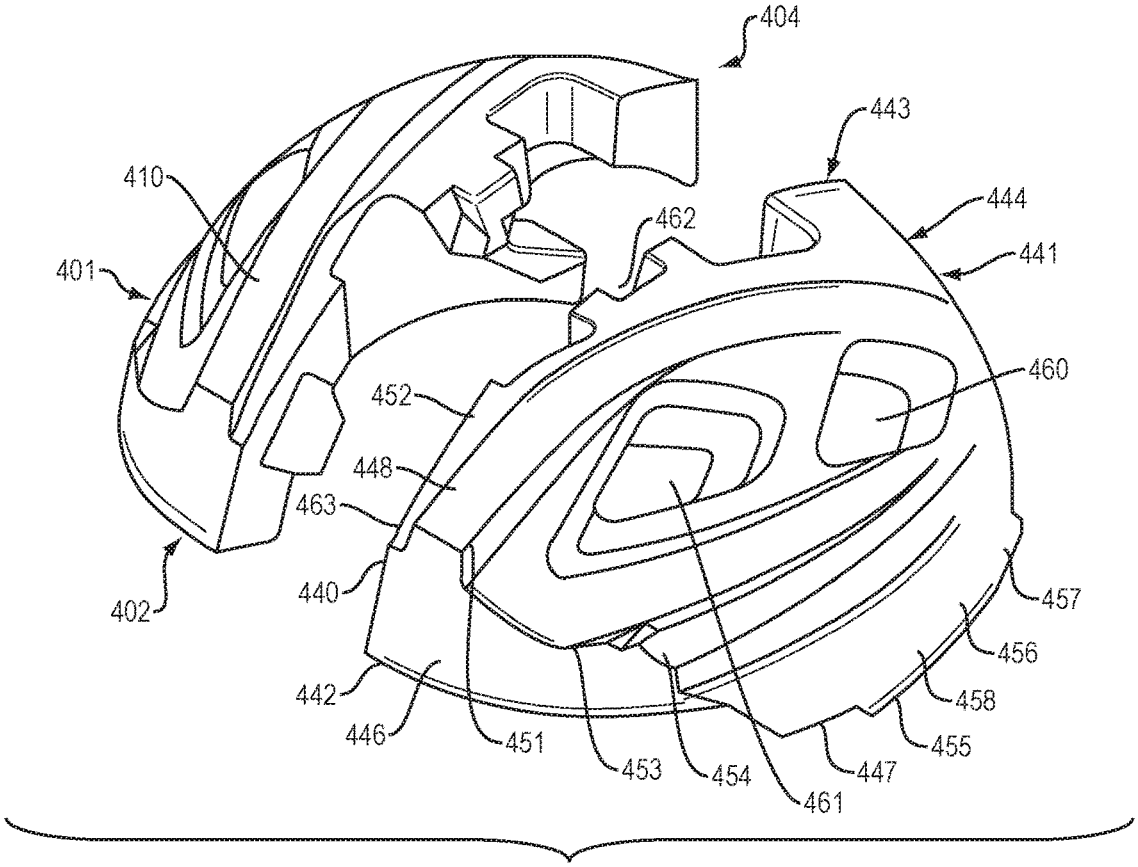
FIG. 21A is a perspective view of the left section and right section of the inner shell of the second alternative padding of the subject technology.
Figure 21B:
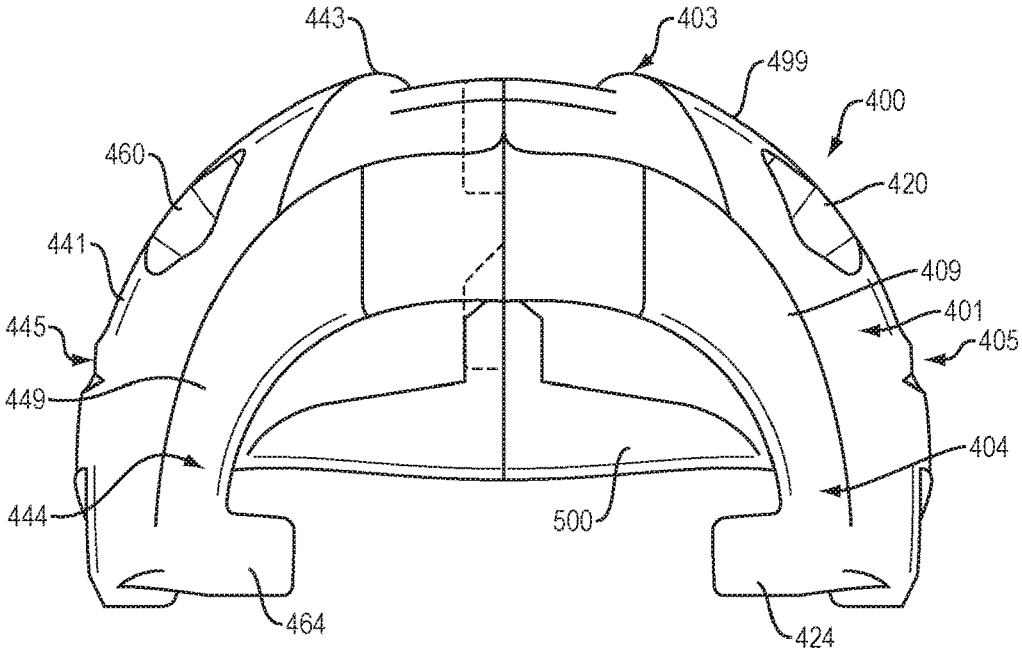
FIG. 21B is a rear view of the assembled left section and right section of the inner shell of the second alternative padding of the subject technology.
Figure 22A:
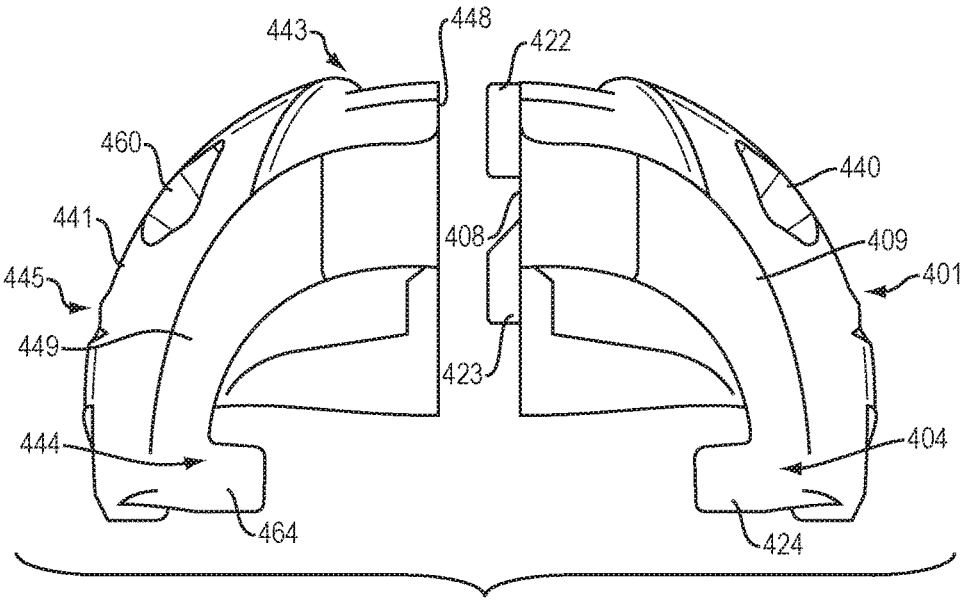
FIG. 22A is a rear view of the left section and right section of the inner shell of the second alternative padding of the subject technology.
Figure 22B:
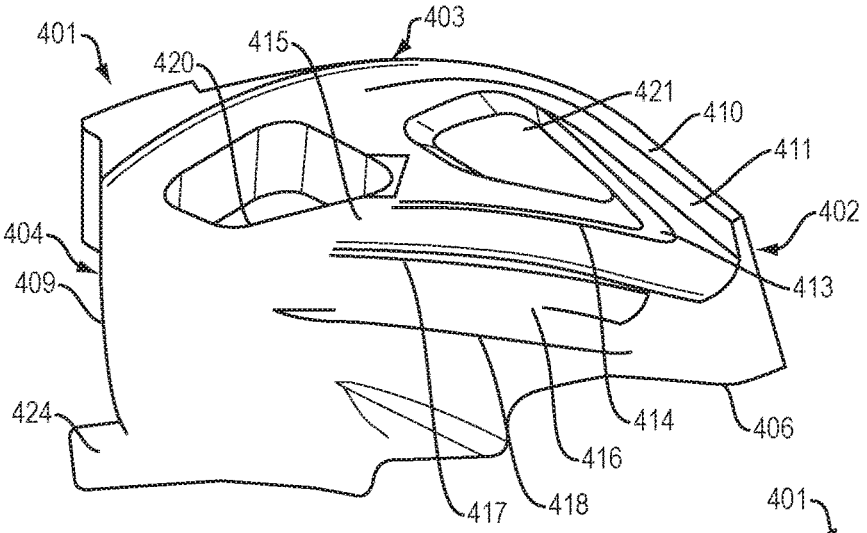
FIG. 22B is a side view of the right section of the inner shell of the second alternative padding of the subject technology.
Figure 22C:
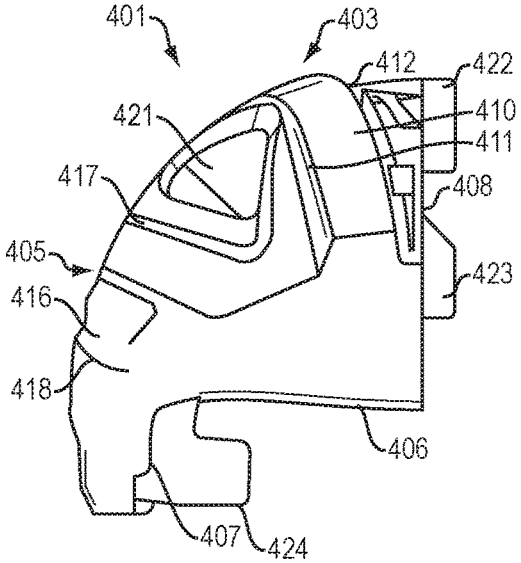
FIG. 22C is a front view of the right section of the inner shell of the second alternative padding of the subject technology.

FIGS. 19 through 22C show an alternative padding structure which may be used in helmet 1. As shown in FIGS. 19 and 20, helmet 1 may be provided with an inner shell (or bonnet) 400 as hereinafter described, nested within shell 10. Inner shell 400 is provided with crown comfort layer 500 and rear comfort layer 530 as hereinafter described.

As shown in FIGS. 21A, 21B, 22A, 22B, and 22C, inner shell 400 comprises three interlocking sections including right section 401, left section 441, and rear section 461. Sections 401, 441, 461 may be composed of expanded polypropylene, expanded polystryrene, or similar bead foam of the types used in protective helmets. Sections 401, 441, 461 may be formed by molding.

Inner shell 400 has an outer surface 499 composed of the respective outer surfaces of interlocking sections 401, 441, 461 and an inner surface 500 composed of the respective inner surfaces of interlocking sections 401, 441, 461. Outer surface 499 is structured and molded so as to generally conform with the structure of the inner surface of shell 10. Preferably there should be close-enough conformance of outer surface 499 to the inner surface of shell 10 such that the inner shell 400 nests within shell 10 without interference.

Turning now to the structure of the sections of inner shell (or bonnet) 400, right section 401 has a front region 402, a crown region 403, a rear region 404, and a right side region 405. Right section 401 is bordered by an edge comprising top front edge 406, right front edge 407, central edge 408, and rear edge 409. The outer surface of right section 401 has acclivities integrally molded therein to define features in the section. More particularly, right section 401 has a plateau 410 partially defined by acclivities 411, 412 extending from the front 402 of the section 401 towards the crown 403. Preferably, plateau 410 is sized and shaped to nest within the negative space formed on the inner surface of shell 10 by right plateau 20. A right brow acclivity 413 and a right side acclivity 414 join acclivity 411 to partially define a right side valley 415. Preferably, right side valley 415 is sized and shaped to nest over the protrusion formed on the inner surface of shell 10 by right side valley 34. Right section 401 may have a right temporal plateau 416 partially defined by acclivities 417, 418 running from the right front edge 407 toward the rear 404 of the right section 401. Preferably, right temporal plateau 416 is sized and shaped to nest within the negative space formed on the inner surface of shell 10 by right temporal plateau 49. A ridge 419 may be preferably sized and shaped to net within the negative space formed on the inner surface of shell 10 by acclivity 45.

Right section 401 may have through-going ventilation holes preferably sized and shaped to register with ventilation holes in shell 10. In the illustrated embodiment, right section 401 has through-going ventilation holes 420, 421, sized and shaped to register with ventilation holes 101, 102 in shell 10. Ventilation hole 421 is partially surrounded by acclivities to nest over the protrusion formed on the inner surface of shell 10 by the acclivities surrounding ventilation hole 102.

Central edge 408 has protrusions 422, 423 for mating with notches 462, 463 in left section 441 as hereinafter described. Rear region 404 has a protrusion 424 extending from rear edge 409 for mating with a notch 491 in rear section 481 as hereinafter described. The thickness of right section 401 may vary but is overall approximately one inch thick.

Left section 441 has a front region 442, a crown region 443, a rear region 444, and a left side region 445. Left section 441 is bordered by an edge comprising top front edge 446, left front edge 447, central edge 448, and rear edge 449. The outer surface of left section 441 has acclivities integrally molded therein to define features in the section. More particularly, left section 441 has a plateau 440 partially defined by acclivities 451, 452 extending from the front 442 of the section 441 towards the crown 443. Preferably, plateau 450 is sized and shaped to nest within the negative space formed on the inner surface of shell 10 by left plateau 21. A left brow acclivity 453 and a left side acclivity 454 join acclivity 451 to partially define a left side valley 455. Preferably, left side valley 455 is sized and shaped to nest over the protrusion formed on the inner surface of shell 10 by left side valley 37.

Left section 441 may have a left temporal plateau 456 partially defined by acclivities 457, 458 running from the left front edge 447 toward the rear 444 of the left section 441. Preferably, left temporal plateau 456 is sized and shaped to nest within the negative space formed on the inner surface of shell 10 by left temporal plateau 50. A ridge 459 may be preferably sized and shaped to net within the negative space formed on the inner surface of shell 10 by acclivity 46. Left section 441 may have through-going ventilation holes preferably sized and shaped to register with ventilation holes in shell 10. In the illustrated embodiment, left section 441 has through-going ventilation holes 460, 461, sized and shaped to register with ventilation holes 103, 104 in shell 10. Ventilation hole 461 is partially surrounded by acclivities to nest over the protrusion formed on the inner surface of shell 10 by the acclivities surrounding ventilation hole 104.

Central edge 448 has notches 462, 463 for mating with protrusions 422, 423 in right section 441 as hereinafter described. Rear region 444 has a protrusion 464 extending from rear edge 449 for mating with a notch 492 in rear section 481 as hereinafter described. The thickness of left section 441 may vary but is overall approximately one inch thick.

Figure 23A:
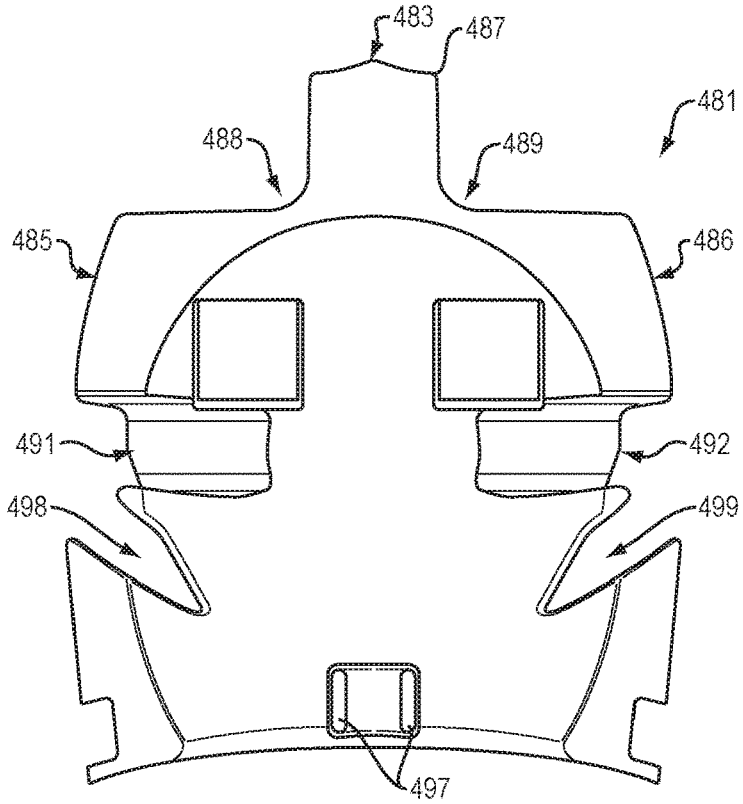
FIG. 23A is a front view of the rear section of the inner shell of the second alternative padding of the subject technology.
Figure 23B:
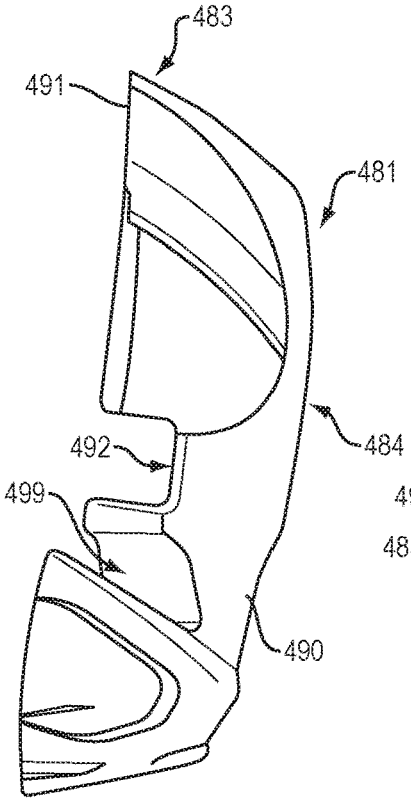
FIG. 23B is a side view of the rear section of the inner shell of the second alternative padding of the subject technology.
Figure 23C:
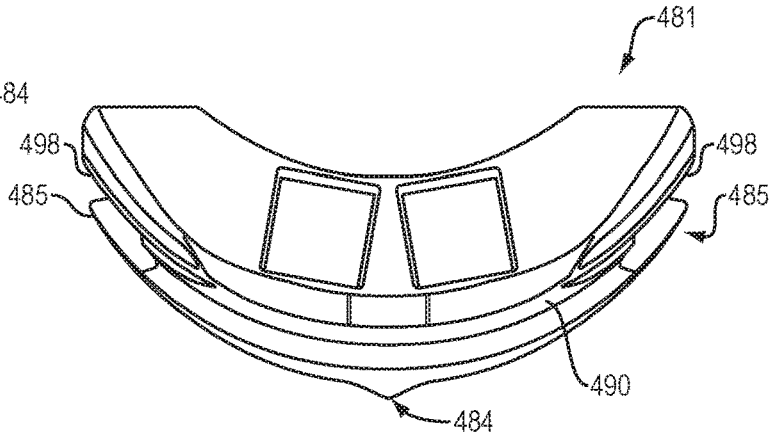
FIG. 23C is a bottom view of the rear section of the inner shell of the second alternative padding of the subject technology.
Figure 24:
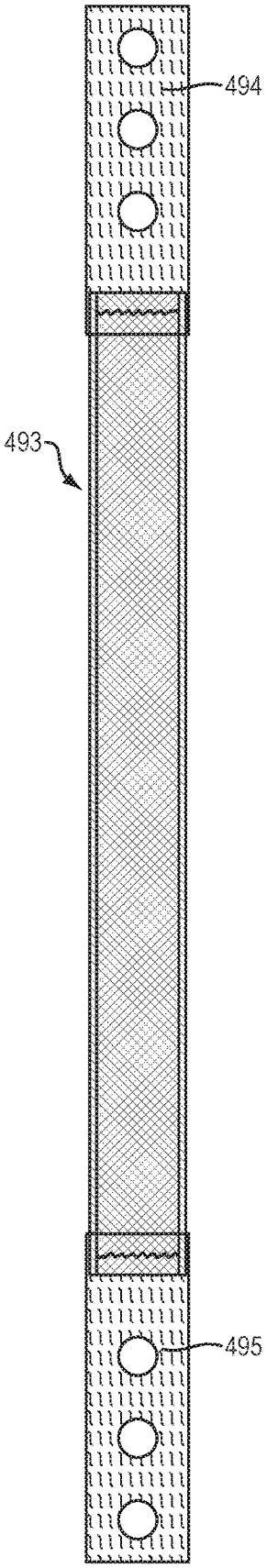
FIG. 24 is a front view of a strap for use with the rear section of the inner shell of the second alternative padding of the subject technology.

As shown in FIGS. 23A, 23B, and 23C, rear section 481 has a has a top region 483, a rear region 484, a right side region 485, and a left side region 486. Top region 483 has a central pillar 487 defining voids 488, 489 on the left and right sides of pillar 487. Voids 488, 489 register with ventilation holes 106, 107 in shell 10 when inner shell 400 is installed in shell 10. Rear section 481 may have a channel 490 extending across rear region 484 and sized and shaped to nest over the protrusion formed on the inner surface of shell 10 by channel 59. Where channel 59 contains ventilation holes, notches 498, 498 may be formed in channel 490, sized and shaped to register with ventilation holes 110, 111 in channel 59. Notches 491, 492 are formed in right side region 485 and left side region 486, respectively, to mate with protrusions 424, 464, respectively. Rear region 484 may include left valley 491 and right valley (not shown), both partially defined by acclivities, both sized and shaped to nest over the protrusions formed on the inner surface of shell 10 by left lower side depression 68 and right lower side depression 69, respectively. Rear region 484 may include a pair of through-going slots 497 for receiving an elastic strap 493. As shown in FIG. 24, strap 493 may be made of any suitable elastic band material and have attached at the ends thereof tabs 494, 495 having holes for receiving T-nuts, for securing inner shell 400 to shell 10 as hereinafter described.

Figure 25B:
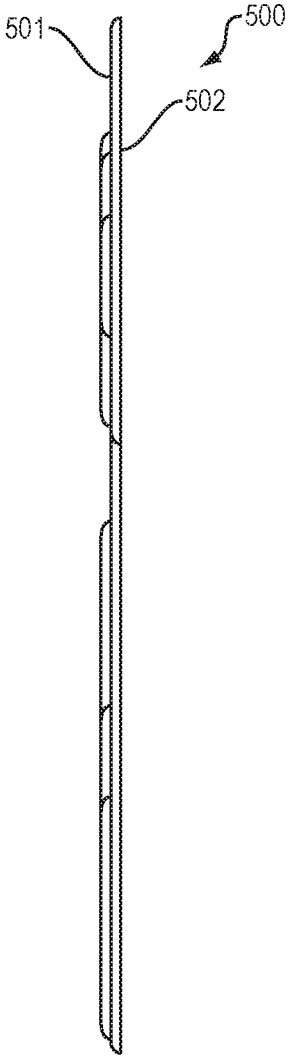
FIG. 25B is a side view of a crown comfort layer of the second alternative padding of the subject technology.
Figure 25A:
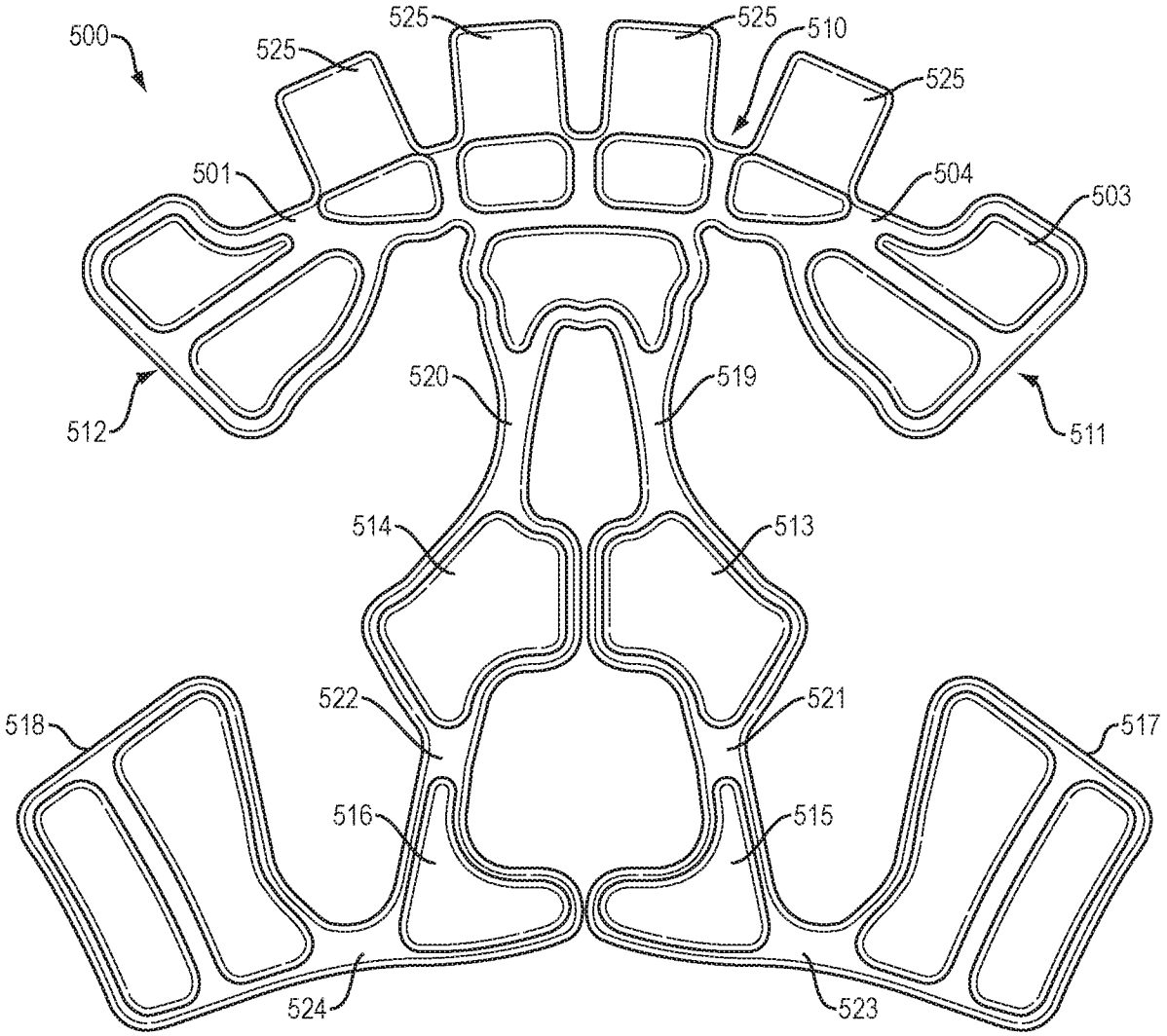
FIG. 25A is a front view of a crown comfort layer of the second alternative padding of the subject technology.

Inner shell 400 is provided with one or more comfort layers removably attached to its inner surface. For example, in the embodiment illustrated in FIGS. 25A and 25B, crown comfort layer 500 is composed of a foam cushion layer 501, such as ethylene vinyl acetate foam, backed by a loop fabric layer 502. Foam cushion layer 501 may be formed by molding. Foam cushion layer 501 has pads 503 integrally molded into it, the pads being connected by a base layer 504. Crown comfort layer 500 is shaped to avoid the ventilation through-holes in inner shell 400 by defining negative spaces which will fully or partially surround the ventilation through-holes when crown comfort layer 500 is installed on the inner surface of inner shell 400.

Viewed another way, crown comfort layer 500 is composed of a plurality of lobes, each lobe having one or more pads integrally molded therewith. The lobes may be directly connected to adjacent lobes or may be connected by relatively narrow isthmoid structures to adjacent lobes. More particularly, in the embodiment illustrated in FIGS. 25A and 25B, crown comfort layer 500 comprises front central lobe 510, left front lobe 511, right front lobe 512, left crown lobe 513, right crown lobe 514, left rear crown lobe 515, right rear crown lobe 516, left rear lobe 517, and right rear lobe 518. Front left lobe 511 and front right lobe 512 are each directly connected to front central lobe 510. Front central lobe 510 is connected to each of left crown lobe 513, right crown lobe 514 by isthmoid structures 519, 520, respectively. Left crown lobe 513 and right crown lobe 514 are connected by isthmoid structures 521, 522, respectively, to left rear crown lobe 515, and right rear crown lobe 516, respectively. Left rear crown lobe 515 and right rear crown lobe 516 are connected to left rear lobe 517 and right rear lobe 518 by isthmoid structures 523, 524, respectively. Isthmoid structures 519, 520, 521, 522, 523, 524 are formed from base layer 504. Crown comfort layer 500 has one or more integrally formed tabs 525 extending forward from front central lobe 510. Base layer 504 could be approximately 0.10 inches thick. Pads 503 could be approximately 0.20 inches thick.

Figure 26B:
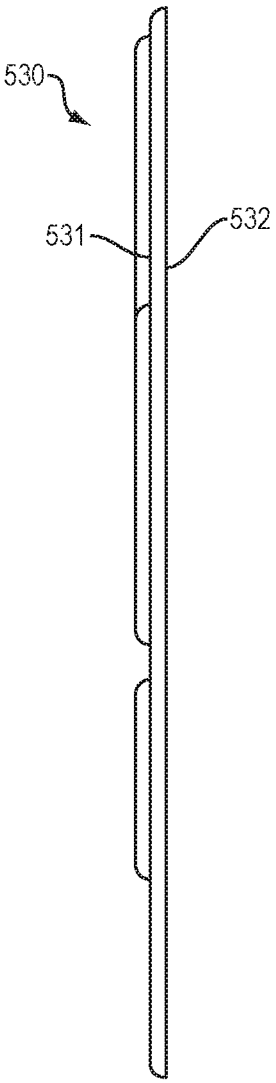
FIG. 26B is a side view of a rear comfort layer of the second alternative padding of the subject technology.
Figure 26A:
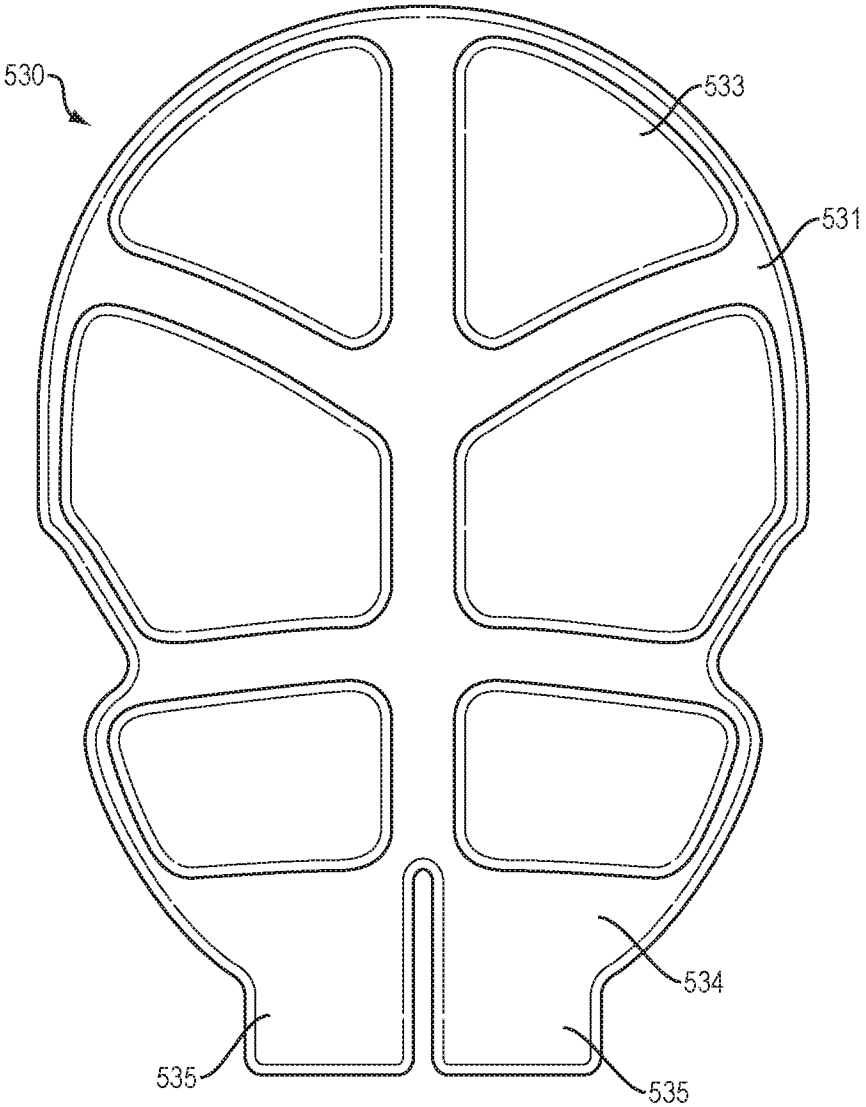
FIG. 26A is a front view of a rear comfort layer of the second alternative padding of the subject technology.

In the embodiment illustrated in FIGS. 26A and 26B, rear comfort layer 530 is composed of a foam cushion layer 531, such as ethylene vinyl acetate foam, backed by a loop fabric layer 532. Foam cushion layer 531 may be formed by molding. Foam cushion layer 531 has one or more pads 533 integrally molded into it, the pads surrounded by (and if more than one, being connected by) base layer 534. Rear comfort layer 530 is shaped to avoid the ventilation through-holes in inner shell 400 by defining negative spaces 545, 546 which will fully or partially surround the ventilation through-holes when rear comfort layer 530 is installed on the inner surface of inner shell 400. Rear comfort layer 530 has one or more integrally formed tabs 535 extending downward. Base layer 534 could be approximately 0.10 inches thick. Pads 533 could be approximately 0.20 inches thick.

Inner shell 400 is assembled from right section 401, left section 441, rear section 481, crown comfort layer 500, and rear comfort layer 530 as follows. Right section 401 and left section 441 are assembled by aligning and mating notches 462, 463 with protrusions 422, 423. Rear section 481 is assembled with the assembly of sections 401, 441 by aligning and mating protrusions 424, 464 with notches 491, 492. Crown comfort layer 500 is attached by engaging fabric layer 502 with hook fastener pads bonded to the inner surfaces of right section 401 and left section 44. Tabs 525 of crown comfort layer 500 are bendable to engage with hook fastener pads bonded to the forward bottom edges of right section 401 and left section 441. Rear comfort layer 530 is attached by engaging fabric layer 532 with hook fastener pads bonded to the inner surface of rear section 481. Tabs 535 of rear comfort layer 530 are bendable to engage with hook fastener pads bonded to the bottom edge of rear section 481.

Inner shell 400 is placed within shell 10 and is retained by flexure of left side region 14 and right side region 15. Inner shell 400 may be further secured to shell 10 by removably attaching tabs 494, 495 of strap 493 to shell 10 by T-nuts. Strap 493 is elastic between tabs 494, 495 and may be stretched by the connection of tabs 494, 495 to shell 10. When stretched, strap 493 exerts a biasing force on rear section 481 tending to bias rear section 481 toward the wearer's head, thereby achieving a tighter fit. Tabs 494, 495 have multiple holes for connecting to shell 10 to allow the wearer to adjust the amount of biasing force on rear section 481 and thereby adjust the fit of inner shell 400.

IV. Helmet Padding (Third Alternative)

An alternative padding structure which may be used in helmet 1 according to the subject technology is identical to the Helmet Padding (First Alternative), except that the lateral liner 220 is replaced with a lateral padding assembly 600 of padding elements as shown in FIGS. 31-36B and hereinafter described. (Lateral liner 220 may also be regarded as being within the scope of the term "lateral padding assembly.")

Figure 31:
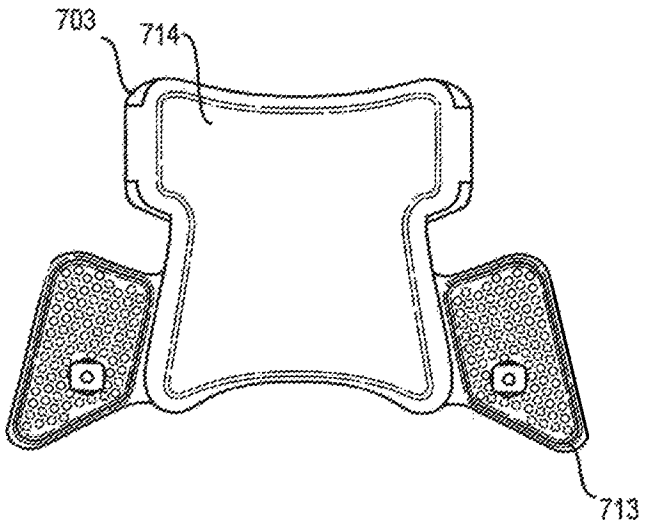
FIG. 31 is a front view of the central lateral element of the third alternative padding according to the subject technology.
Figure 32A:
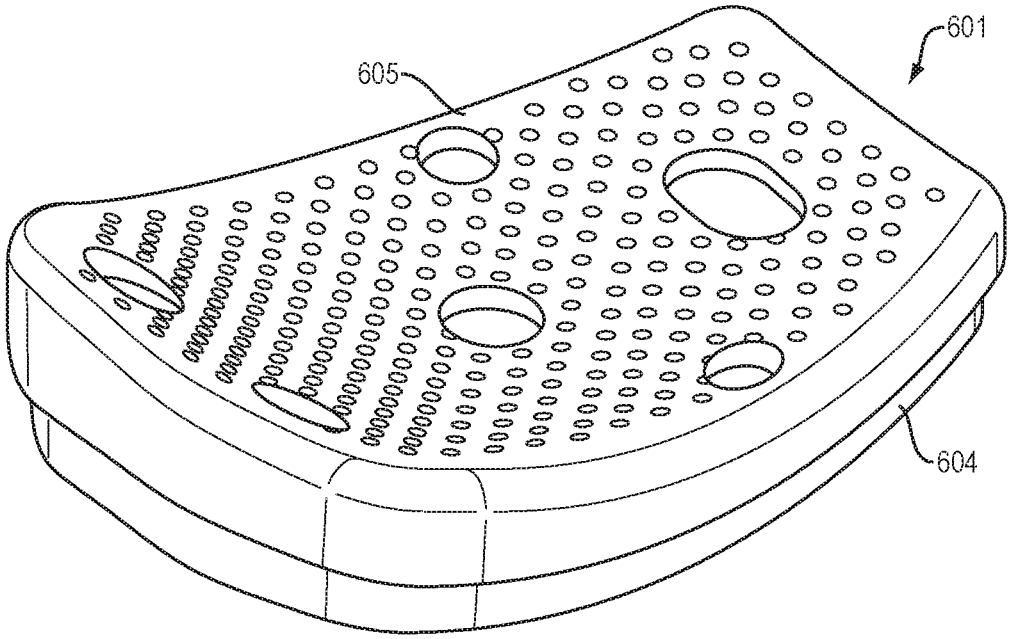
FIG. 32A is a perspective view of a side lateral element of a third alternative padding according to the subject technology.
Figure 32B:
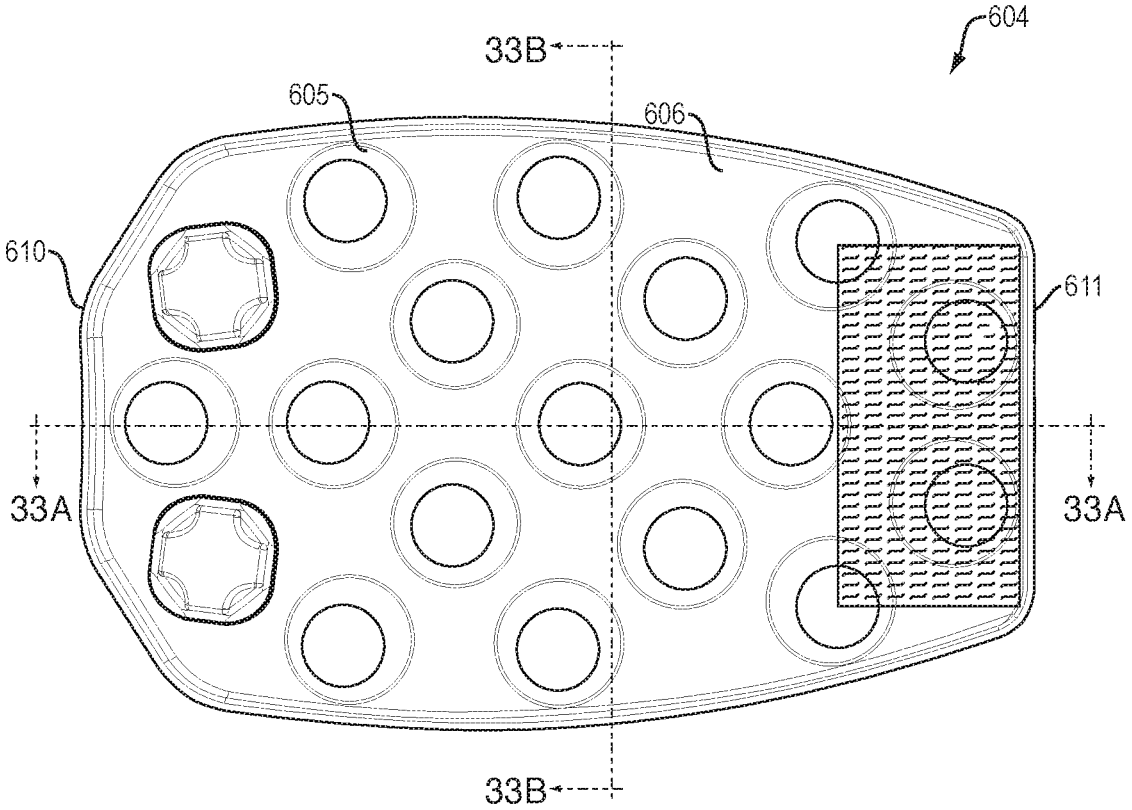
FIG. 32B is a front view of a shock absorbing layer of a side lateral element of a third alternative padding according to the subject technology.
Figure 33A:
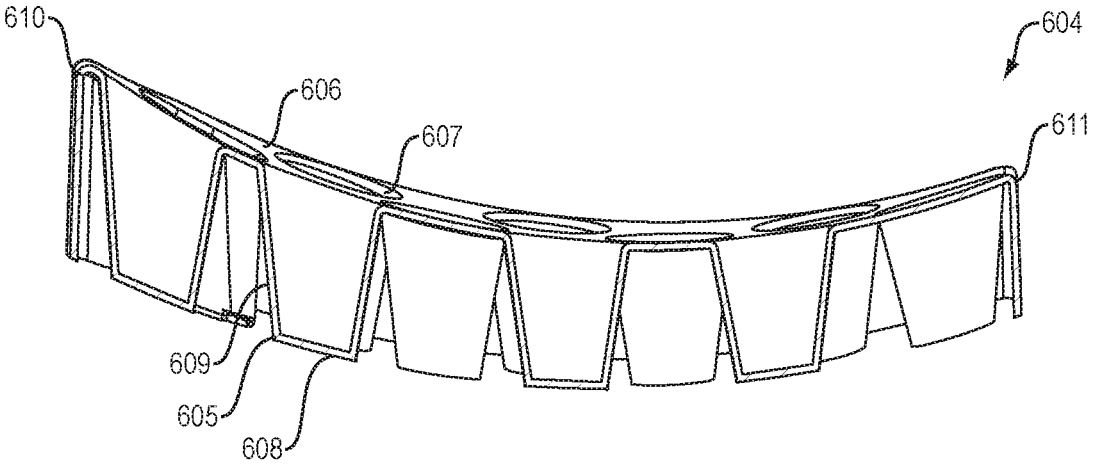
FIG. 33A is a cross-sectional side view of a shock absorbing layer of a side lateral element of a third alternative padding according to the subject technology.
Figure 33B:
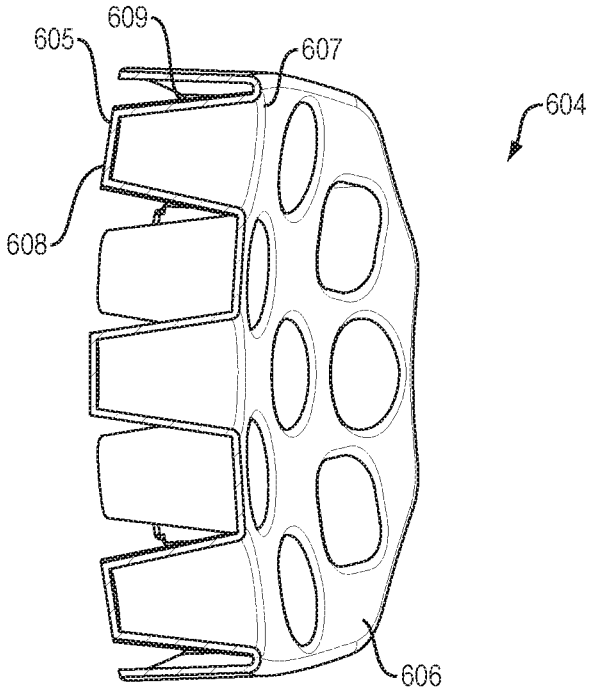
FIG. 33B is a cross-sectional perspective view of a shock absorbing layer of a side lateral element of a third alternative padding according to the subject technology.
Figure 34A:
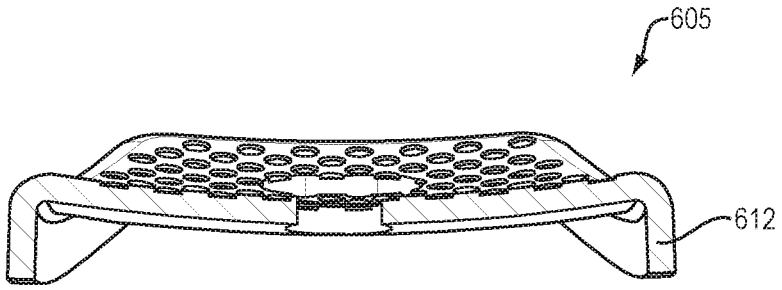
FIG. 34A is a cross-sectional side view of a comfort layer of a side lateral element of a third alternative padding according to the subject technology.
Figure 34B:
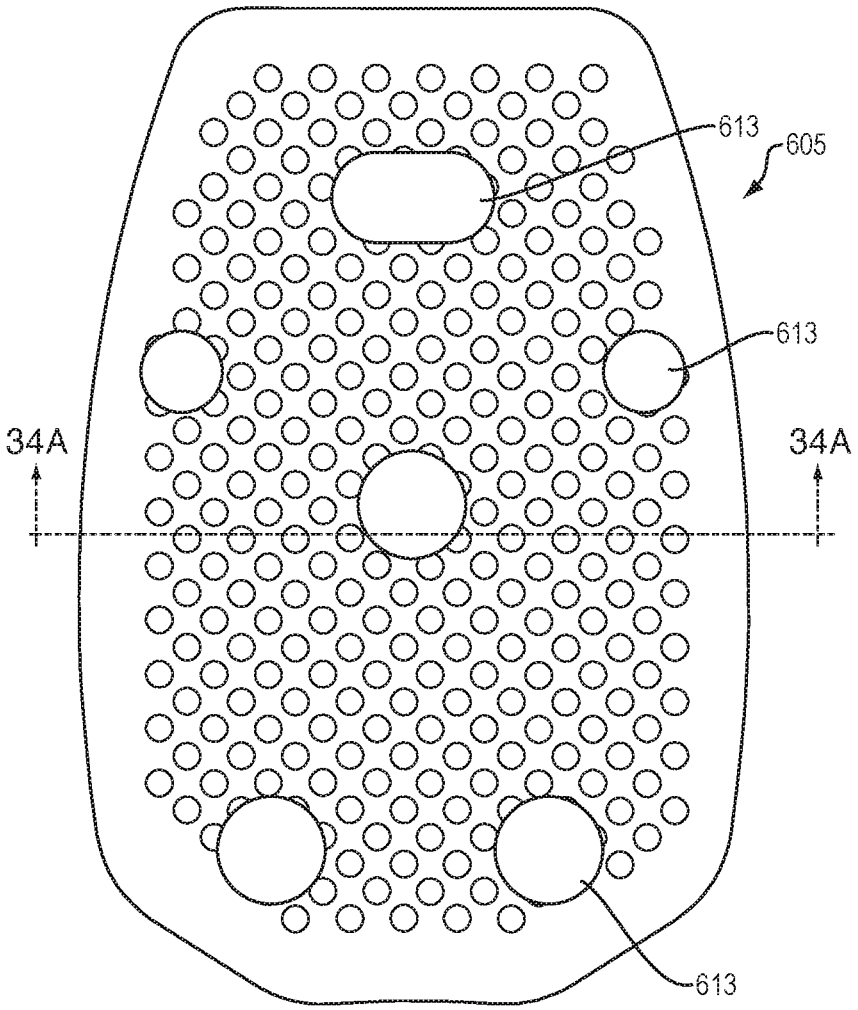
FIG. 34B is a front view of a comfort layer of a side lateral element of a third alternative padding according to the subject technology.

As shown in FIG. 31, lateral padding assembly 600 is composed of three padding elements, specifically side lateral elements 601 and central lateral element 703. Side lateral elements 601 are installed in the helmet as described below, abutting central lateral element 703 as shown in FIG. 31, but elements 601 and 703 are not necessarily connected otherwise.

As seen in FIGS. 32A-34B, side lateral elements 601 are composed of a shock absorbing layer 604 and a comfort layer 605. Shock absorbing layer 604, is advantageously formed from thermoplastic urethane ("TPU"). Protective arrangements for helmets formed of injection molded TPU parts are disclosed in U.S. Pat. No. 8,069,498, and the TPU layers of the shock absorbing layer 604 may be constructed as in that patent, the entirety of which is incorporated by reference. Suitable TPU material is available from Bayer. Layer 604 may be fabricated by injection molding. Layer 604 has a plurality of spaced-apart projecting hollow protrusions 605 protruding from a base sheet 606 and distributed over the coverage area. Each protrusion 605 has an open, preferably circular larger diameter base 607 at the sheet 606 from which it extends, a smaller diameter, preferably flat circular peak 608, and a preferably curved or straight frustoconical side wall 609 that tapers from the open base 607 to the closed peak 608. A circular peak may be formed with a peak opening therein. Ribs (not shown) may be integrally formed in sheet 606 extending between adjacent protrusions for added stability. Each side wall 609 is collapsible for absorbing shocks which may be transmitted to each protrusion 605. The protrusions are spaced apart from each other for distributing the shock-absorbing effects of the protrusions over the coverage area of layer 604. The protrusions located at the outer side 610 are somewhat taller (i.e., their sidewalls are somewhat longer by a first distance) than the protrusions at the inner side 611 and will be compressed first during a shock, to better distribute the shock across the coverage area. The height of the taller protrusions located at outer side 610 may be 1 inch or approximately 1 inches. The height of the shorter protrusions at the inner side 611 may be 0.76 inches or approximately 0.76 inches. The thickness of base sheet 606, side walls 609, and peaks 608, may be 0.04 inches or approximately 0.04 inches. Shock absorbing layer 604 is curved so that peaks 608 generally conform to the inner surface of shell 10.

Comfort layer 605 is formed of a soft foam material, for example, ethylene vinyl acetate foam such as those sold under the Cell-Flex brand by the DER-TEX Corporation of Saco, Me. Comfort layer 605 is formed in a cup-like configuration with a rim 612, such that shock absorbing layer 604 partially nests within comfort layer 605. Comfort layer 605 may be provided with through-going holes 613. A fabric layer may be adhered to the inner surface of comfort layer 605 to mate with hook pads welded to the base sheet 606 of shock absorbing layer 604, thereby removably attaching the two elements. Alternatively, hook pads could be adhered to base sheet 606 rather than welded. A welded bond is preferred, as adhesive bonds can become loose during use of the helmet in sports play. Suitable welding techniques include ultrasonic welding. Wherever hook pads or loop pads are bonded to single-layer TPU material in the subject technology, welding is a preferred technique over the use of adhesives.

Side lateral elements 601 may be removably attached to shell 10 by means of male snap screws passing through holes formed in shell 10 and corresponding holes in peaks at the outer side 610, and retained by T-nuts. The male snap screws may serve as connection points for a chin strap.

Central lateral element 703 is removably attached to the inner surface of shell 10 and generally at least partially overlies the occipital area, i.e. the occipital bone and adjacent skull structures of the wearer. Central lateral element 703 is comprised of central foam element 713 and comfort layer 714.

Figure 35A:
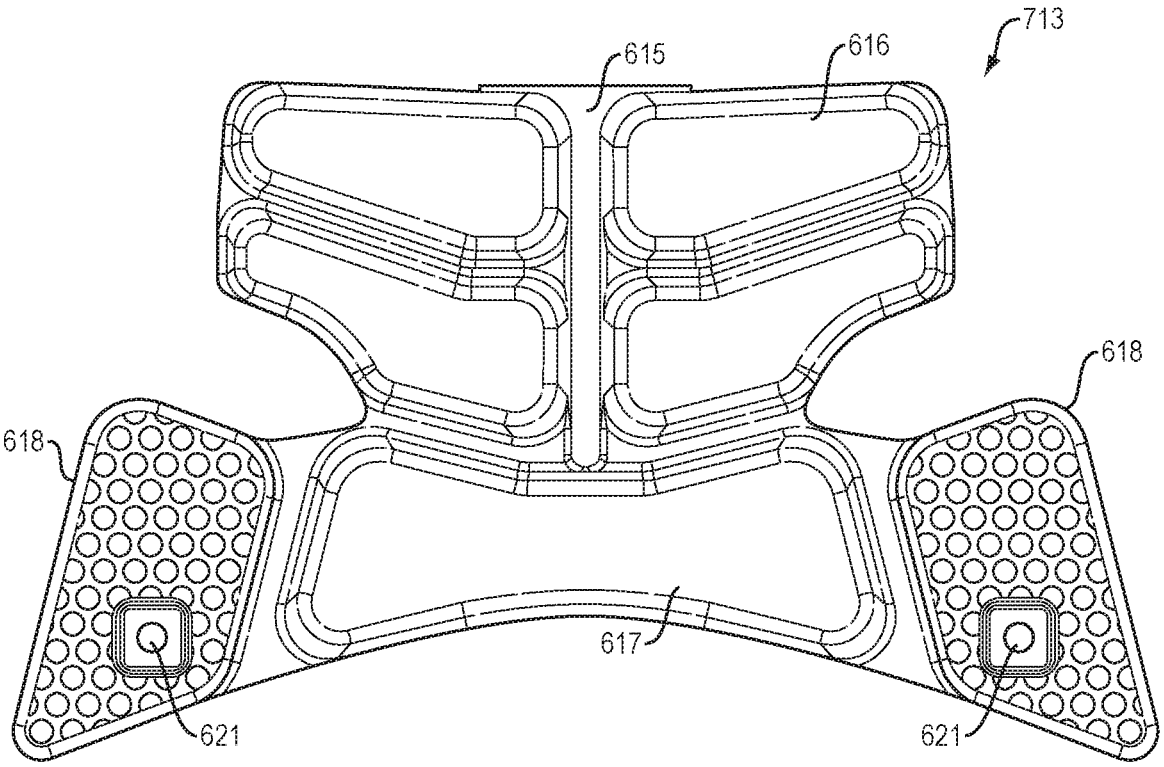
FIG. 35A is a front view of a central foam element of a third alternative padding according to the subject technology.
Figure 35B:
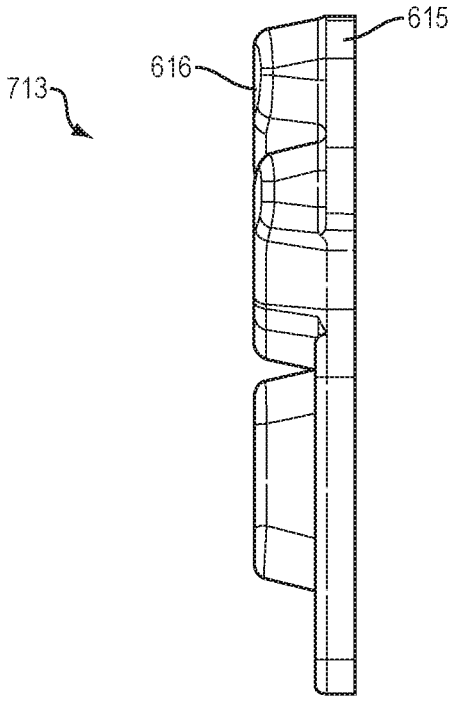
FIG. 35B is a side view of a central foam element of a third alternative padding according to the subject technology.

As seen in FIGS. 35A and 35B, central foam element 713 may be formed out of a flexible foam padding material, shock foam, or the like. Preferably, central foam element 713 is formed from a flexible, rate-sensitive shock absorbing material. A suitable rate-sensitive shock absorbing material is available under the trade name D3O® from D3O Lab of Brighton, East Sussex BN41 1DH, UK. Central foam element 713 may be formed by molding. Central foam element 713 comprises base layer 615 and a plurality of pads 616 (only one is numbered) integrally formed with base layer 615. Central foam element 713 may have a fabric backing of flocked material, tricot or the like.

Central foam element 713 comprises a central region 617 and wings 618 extending laterally outward from central region 617. Central region 617 and wings 618 are integrally formed and connected by common base layer 615. Each of pads 616 may taper from a relatively wide base to a relatively narrow plateau and are closely spaced in their distribution across base layer 615 for good shock protection. Plateaus of pads 616 may be textured by dimpling, pebbling or crosshatching. Central region 617 is shown as having five pads, but could alternatively have two, three, four, or six pads. Wings 618 are shown as having one pad, but could have two or three pads. Wings 618 are divided from central region 617 by living hinge sections of base layer 615 to permit flexure of central foam element 713 about the hinges.

The thickness of base layer 615 may be 0.35 inches or approximately 0.35 inches. The thickness of pads 616 including the underlying base layer 615 may be 0.875 inches or approximately 0.875 inches.

Figure 36A:
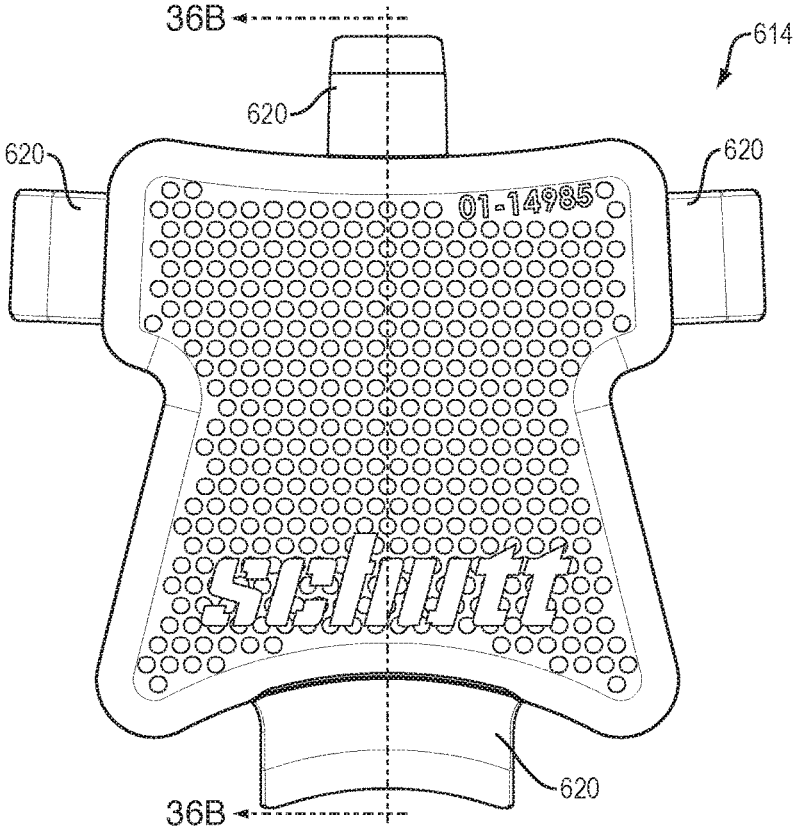
FIG. 36A is a front view of a central comfort layer of a third alternative padding according to the subject technology.
Figure 36B:
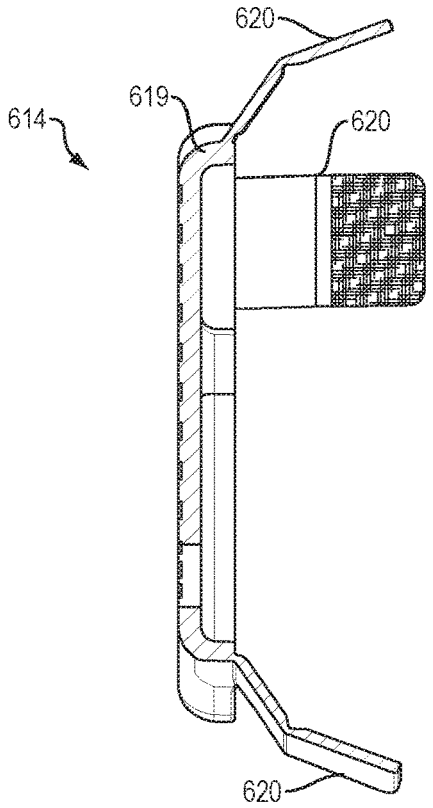
FIG. 36B is a cross-sectional side view of a central comfort layer of a third alternative padding according to the subject technology.

As seen in FIGS. 36A and 36B, comfort layer 714 is formed of a soft foam material, for example, ethylene vinyl acetate foam such as those sold under the Cell-Flex brand by the DER-TEX Corporation of Saco, Me. Comfort layer 714 is formed in a shape to generally overlay and cover central region 617 and has a cup-like configuration with a rim 619, such that central foam element 713 partially nests within comfort layer 714. Comfort layer 714 is provided with integrally formed tabs 620 having hook tapes adhered to the back of the tabs. The tabs 620 which wrap around to the back of central foam element 713 and thereby releaseably engage comfort layer 714 with central foam element 713 by engagement of the hook tapes with the fabric backing. Comfort layer 714 may have a thickness of 0.20 inches or approximately 0.20 inches. Tabs 620 may have a thickness of 0.10 inches or approximately 0.10 inches.

Central lateral element 603 may be removably attached to shell 10 by means of male snap screws passing through holes formed in shell 10 and corresponding holes 621 formed in wings 618, and retained by T-nuts. The male snap screws may serve as connection points for a chin strap.

While a specific embodiment of the invention has been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention. Thus, all the features of all the embodiments disclosed herein are interchangeable so that any element of any embodiment may be applied to any of the embodiments taught herein.

What is claimed is:

1. A sports helmet comprising:

a single-piece plastic shell adapted to receive and protect the head of a wearer; the shell having a front region, a crown region, a rear region, a left side region, a right side region, an inner surface and an outer surface;

an occipital shock absorber attached to the inner surface of the shell in the rear region to at least partially overlie an occipital area of the head;

an inflatable occipital pad removably attached to the inner surface of the shell in the rear region and positioned between the inner surface of the shell and the occipital shock absorber to push the occipital shock absorber forward when the inflatable occipital pad is inflated;

the inflatable occipital pad comprising a top sheet and a bottom sheet bonded together, a plurality of inflatable pockets formed in the top sheet and fluidly connected through channels formed in the top sheet, the plurality of inflatable pockets comprising a central inflatable pocket, a plurality of left side inflatable pockets in serial fluid connection with the central inflatable pocket and extending in a series to the left of the central inflatable pocket, and a plurality of right side inflatable pockets in serial fluid connection with the central inflatable pocket and extending in a series to the right of the central inflatable pocket, a valve assembly for inflating the plurality of inflatable pockets, the valve assembly bonded to the bottom sheet at the central inflatable pocket and in fluid communication with the central pocket, wherein the inflatable occipital pad further comprises a plurality of non-inflatable pockets formed in the top sheet surrounding the central inflatable pocket;

a valve hole in the shell, the valve assembly extending through the valve hole;

a crown shock absorber attached to the inner surface of the shell in the crown region;

a left jaw pad attached to the inner surface of the shell in the left side region to at least partially overlie an upper left jaw of the head;

a right jaw pad attached to the inner surface of the shell in the right side region to at least partially overlie an upper left jaw of the head;

wherein the central inflatable pocket is positioned behind the inflatable occipital pad and has a left side and a right side, the left side adjacent to a left gap which permits said serial fluid connection with the plurality of left side inflatable pockets, the right side adjacent to a right gap which permits said serial fluid connection with the plurality of right side inflatable pockets; and a brow plateau formed in the shell in the front region, the brow plateau being partially defined on a left side by a left brow acclivity and a left side acclivity, and being partially defined on a right side by a right brow acclivity and a right side acclivity.

2. The sports helmet of claim 1 wherein the shell has a left earhole having four edges in the left region and a right earhole having four edges in the right region.

3. The sports helmet of claim 1 wherein the occipital shock absorber comprises a central foam element and comfort layer disposed on the central foam element; the central foam element has a fabric backing; the comfort layer has a tab formed at a bottom edge of the comfort layer; the tab has hook tape adhered on the surface thereof; the tab wraps around to the back of the central foam element and releaseably engages the comfort layer with central foam element by engagement of the hook tape with the fabric backing; and an end of the tab is disposed between the central foam element and the inflatable occipital pad.

4. A sports helmet comprising:

a single-piece plastic shell adapted to receive and protect the head of a wearer; the shell having a front region, a crown region, a rear region, a left side region, a right side region, an inner surface and an outer surface;

an occipital shock absorber attached to the inner surface of the shell in the rear region to at least partially overlie an occipital area of the head;

an inflatable occipital pad removably attached to the inner surface of the shell in the rear region and positioned between the inner surface of the shell and the occipital shock absorber to push the occipital shock absorber forward when the inflatable occipital pad is inflated through a valve;

a crown shock absorber attached to the inner surface of the shell in the crown region;

a left jaw pad attached to the inner surface of the shell in the left side region; and a right jaw pad attached to the inner surface of the shell in the right side region;

wherein the occipital shock absorber comprises a central foam element and comfort layer disposed on the central foam element; the central foam element has a fabric backing; the comfort layer has a tab formed at a bottom edge of the comfort layer; the tab has hook tape adhered on the surface thereof; the tab wraps around to the back of the central foam element and releaseably engages the comfort layer with central foam element by engagement of the hook tape with the fabric backing; and an end of the tab is disposed between the central foam element and the inflatable occipital pad.

5. The sports helmet of claim 4 further comprising a brow plateau formed in the shell in the front region, the brow plateau being partially defined on a left side by a left brow acclivity and a left side acclivity, and being partially defined on a right side by a right brow acclivity and a right side acclivity.

6. The sports helmet of claim 4 wherein the shell has a left earhole having four edges in the left region and a right earhole having four edges in the right region.

7. The sports helmet of claim 1 further comprising:

a full jaw protector removably attached to the shell at a right side of the shell and at a left side of the shell and extending forwardly from the shell and extending continuously from the right side of the shell to the left side of the shell and adapted to cover and protect a lower jaw of the wearer;

a faceguard removably attached to the shell and removably attached to the full jaw protector;

the faceguard comprising a grid of a plurality of horizontal wire members, a plurality of vertical wire members, and a bottom wire member;

a left loop strap and a right loop strap attaching the bottom wire member to the full jaw protector, the bottom wire member positioned parallel to and above a forward extent of the full jaw protector and passing through the left loop strap and the right loop strap;

wherein a first one of said plurality of vertical wire members is attached to the bottom wire member to form a first T-intersection between the first one of said plurality of vertical wire members and the bottom wire member at a position adjacent to and above the full jaw protector and forward of the left loop strap, such that the left loop strap resists the tendency of the faceguard to slide and twist when struck with blows during sports play; and wherein a second one of said plurality of vertical wire members is attached to the bottom wire member to form a second T-intersection between the second one of said plurality of vertical wire members and the bottom wire member at a position adjacent to and above the full jaw protector and forward of the right loop strap such that the right loop strap resists the tendency of the faceguard to slide and twist when struck with blows during sports play; and wherein the left loop strap acts as a stop against rearward movement of the first one of said plurality of vertical wire members and the right loop strap acts as a stop against rearward movement of the second one of said plurality of vertical wire members.

* * * * *